US008087115B2

(12) United States Patent
Barber et al.

(10) Patent No.: US 8,087,115 B2
(45) Date of Patent: Jan. 3, 2012

(54) APPARATUS HAVING ONE OR MORE REMOVABLE TOOLS

(75) Inventors: Launce Reed Barber, Bradenton, FL (US); Thomas Richard Stokes, Williamsburg, VA (US)

(73) Assignee: Elemental Tools, LLC, Richmond, VA (US)

( * ) Notice: Subject to any disclaimer, the term of this patent is extended or adjusted under 35 U.S.C. 154(b) by 203 days.

(21) Appl. No.: 12/429,846

(22) Filed: Apr. 24, 2009

(65) Prior Publication Data

US 2009/0265860 A1 Oct. 29, 2009

Related U.S. Application Data

(60) Provisional application No. 61/125,479, filed on Apr. 25, 2008.

(51) Int. Cl.
*B25F 1/02* (2006.01)
*B26B 11/00* (2006.01)

(52) U.S. Cl. ..... 7/167; 7/158; 7/161

(58) Field of Classification Search ..... 7/118, 158, 7/161, 164, 165, 167; D8/99, 105; 30/123, 30/156

See application file for complete search history.

(56) References Cited

U.S. PATENT DOCUMENTS

| | | | | |
|---|---|---|---|---|
| D173,323 | S * | 10/1954 | Polk | D26/38 |
| 4,539,749 | A * | 9/1985 | Hyeong-Woon | 30/147 |
| 4,570,341 | A * | 2/1986 | Konneker | 30/161 |
| 5,038,644 | A * | 8/1991 | Delsack | 81/177.3 |
| 5,270,909 | A | 12/1993 | Weiss et al. | |
| 6,223,372 | B1 * | 5/2001 | Barber | 7/118 |
| D469,023 | S * | 1/2003 | Mah | D10/2 |
| D474,095 | S * | 5/2003 | Luquire | D8/99 |
| 6,622,329 | B2 * | 9/2003 | Ostor et al. | 7/138 |
| D484,770 | S * | 1/2004 | Green | D8/99 |
| 6,742,685 | B2 | 6/2004 | Williams | |
| D505,337 | S | 5/2005 | Cooper | |
| D505,867 | S | 6/2005 | Cooper | |
| D515,948 | S | 2/2006 | Hsu | |
| 7,000,323 | B1 * | 2/2006 | Hatcher et al. | 30/155 |
| 7,048,407 | B2 | 5/2006 | Kumthampinij et al. | |
| 7,106,858 | B2 | 9/2006 | Goldberg | |
| 7,111,349 | B2 | 9/2006 | Goldberg | |
| D529,536 | S | 10/2006 | Oas | |
| D529,944 | S | 10/2006 | Oas | |
| 7,126,484 | B1 * | 10/2006 | Luquire | 340/574 |
| D535,897 | S | 1/2007 | Leung | |
| 2005/0085210 | A1 | 4/2005 | Leung | |
| 2005/0277316 | A1 | 12/2005 | Cohen | |

* cited by examiner

*Primary Examiner* — David B Thomas

(74) *Attorney, Agent, or Firm* — Charter IP, LLC; Matthew J. Lattig

(57) ABSTRACT

A frame has an opening, a gate mechanism partially bounding the opening, and a longitudinally extending rail. A tool that has a slot is adapted to receive the rail to removably attach the tool to the frame. The gate mechanism includes a gate that is pivotably coupled to the frame to permits access to the opening in the frame.

29 Claims, 25 Drawing Sheets

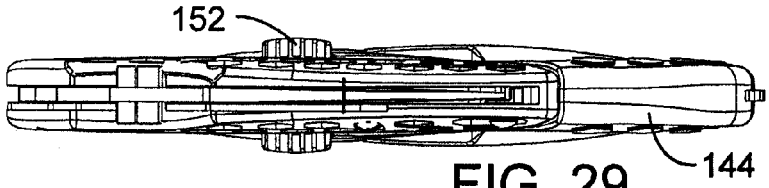
FIG. 29
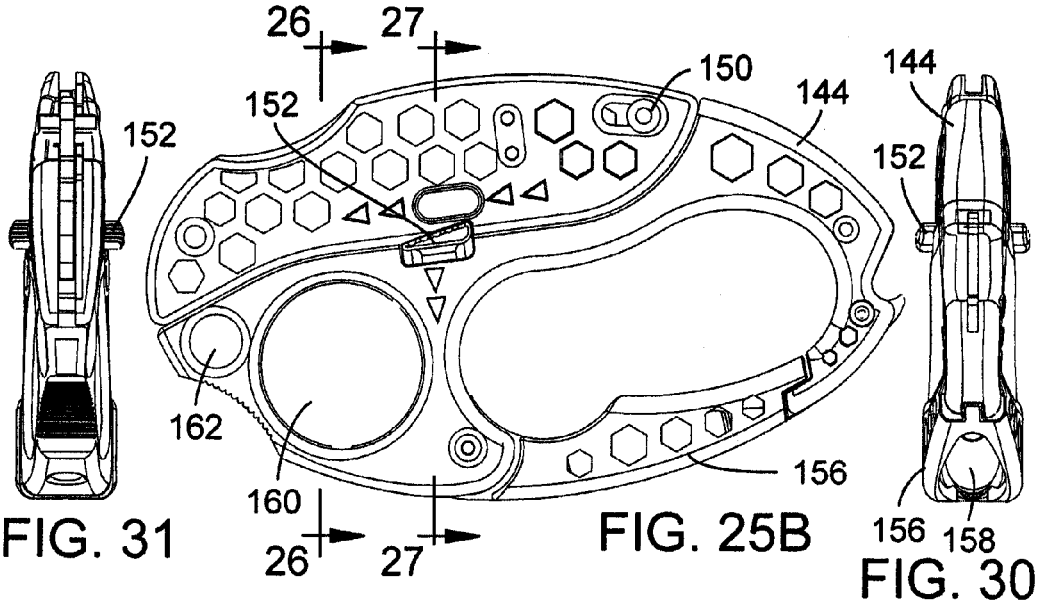
FIG. 31
FIG. 25B
FIG. 30
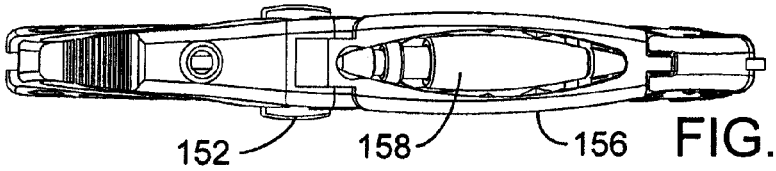
FIG. 28
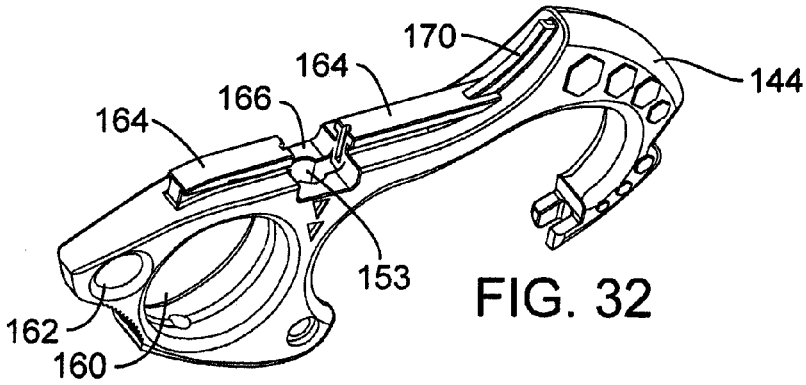
FIG. 32

APPARATUS HAVING ONE OR MORE REMOVABLE TOOLS

CROSS REFERENCE TO RELATED APPLICATION

This application claims the benefit of U.S. provisional application No. 61/125,479, filed Apr. 25, 2008, which is incorporated herein in its entirety for all purposes.

BACKGROUND

The present disclosure concerns embodiments of an apparatus that includes a frame for receiving various removable tools and devices.

DESCRIPTION OF THE RELATED ART

Tools with gate mechanisms, such as carabiner clips, are known. The carabiner style clip system is widely known for its ease of use, functionality, and reliability. In its original and most common form, it is used as a safety device for climbing. The use of carabiner style clips has been extended and integrated into many consumer products for carrying tools, such as writing instruments, watches, dog leashes, and drink containers. These products have carabiner clips permanently fixed to the tool to permit the user to clip the tool to a belt loop or other surface when the tool is not being used.

SUMMARY

The present invention is directed toward new and non-obvious aspects and features of an apparatus and kit that include a frame capable of receiving one or more removable tools, both alone and in various combinations and sub-combinations, which are set forth in the claims below. Unique and non-obvious methods for exchanging tools on a frame system are also disclosed herein.

An apparatus, according to one embodiment, comprises a frame and at least one tool. The frame includes an opening, a gate mechanism partially bounding the opening, and a longitudinally extending rail. The gate mechanism comprises a gate that is pivotably coupled to the frame. The gate is pivotable relative to the frame to permit access to the opening. The at least one tool has a slot adapted to receive the rail to removably attach the tool to the frame.

The apparatus can include a locking mechanism configured to secure the tool to the frame. The locking mechanism can be a latch that is movable between a locked and an unlocked position. The locking mechanism can also be an automatic locking mechanism that automatically secures the tool to the frame when the slot receives the rail. The automatic locking mechanism can include a release mechanism to release the automatic locking mechanism so that the tool may be removed from the frame.

The tool can comprise a folding knife having a handle and a blade that is pivotably connected to the handle. The tool can alternatively (or additionally) include a flashlight, a container with an interior section that is sized to store a lighter, a bit driver, or an electronic device.

The apparatus can comprise a first and second tool, and the frame can comprise at least two longitudinally extending rails. The first and second tools can have a slot adapted to receive one of the rails so that both tools can be removably attached to the frame at the same time.

The apparatus can comprise a first tool, a second tool, and a third tool, and the frame can comprises at least three longitudinally extending rails. The first, second, and third tools can have a slot adapted to receive one of the rails so that all three tools can be removably attached to the frame at the same time.

The frame can comprise an aperture for receiving a secondary tool that is configured to be removably attached at the aperture. The aperture can be substantially cylindrical and the secondary tool can be shaped to fit into the substantially cylindrical aperture.

An apparatus for carrying one or more tools, according to another embodiment, comprises a frame having two openings, two gate mechanism, and two longitudinally extending rails. Each gate mechanism partially bounds one of the openings and each gate mechanism can comprises a gate that is pivotably coupled to the frame. Each gate can be pivotable relative to the frame to permit access to the opening that it partially bounds. Each rail can be adapted for removably mounting a tool the frame.

The frame can include a locking mechanism configured to secure a tool to the frame. The locking mechanism can be a latch that is movable between a locked and an unlocked position. The locking mechanism can also be an automatic locking mechanism that automatically secures a tool to the frame when the tool is received by one of the rails. The automatic locking mechanism can further comprise a release mechanism to release the automatic locking mechanism to permit removal of a tool from the frame.

The frame can further comprise an aperture for receiving a secondary tool and the secondary tool can be configured to be removably attached at the aperture. The aperture can be substantially cylindrical and the secondary tool can be shaped to fit into the substantially cylindrical aperture.

An apparatus, according to another embodiment, can comprise a frame and a folding knife. The frame can have an opening, a gate mechanism partially bounding the opening, and at least one tool receiving section. The knife can comprise a handle and a blade that is pivotably connected to the handle. The handle can be configured to be removably coupled to the frame on the tool receiving section of the frame. The gate mechanism can comprise a gate that is pivotably coupled to the frame, with the gate being pivotable relative to the frame to permit access to the opening.

The tool receiving section can comprise at least one longitudinally extending rail. The handle can comprise at least one slot, and the slot can be adapted to receive the rail to removably attach the tool to the frame.

According to another embodiment, a method of exchanging tools on a frame system is provided. The frame system can comprise a frame having an opening, a gate mechanism partially bounding the opening, and a tool receiving section. The tool receiving section can be adapted to receive and removably attach a tool to the frame. The gate mechanism can comprise a gate that is pivotably coupled to the frame, and the gate can be pivotable relative to the frame to permit access to the opening. The method comprises removing a first tool from the tool receiving section of the frame and installing a second tool on the tool receiving section of the frame. The first tool can be different from the second tool in function.

The first and second tools can each comprise a slot, and the tool receiving section can comprise a rail adapted to receive the slots to removably attach the first and second tools to the frame. The first tool can be a folding knife comprising a handle and a blade that is pivotably connected to the handle.

According to another embodiment, a kit is provided. The kit can comprise a frame system and at least two tools that are different in function from each other. The frame system can comprise a frame that has an opening, a gate mechanism partially bounding the opening, and a tool receiving section.

Each tool can comprise a connecting member configured to connect with the tool receiving section. The tool receiving section can be adapted to receive the connecting member to removably attach each of the tools to the frame. The tools can be interchangeably attachable to the frame on the tool receiving section. The gate mechanism can comprise a gate that is pivotably coupled to the frame, and the gate can be pivotable relative to the frame to permit access to the opening.

The frame system can comprise two tool receiving sections, with each tool receiving section comprising a rail. Each tool can comprise a slot, and the rails can be adapted to receive the slots to removably attach the tools to the frame.

The at least two tools can comprises at least a first tool, a second tool, and a third tool. At least one of the first, second, and third tools can be a folding knife comprising a handle and a blade that is pivotably connected to the handle.

According to another embodiment, an apparatus comprises a first frame, a second frame, and a connecting member. The first and second frame each has an opening, a gate mechanism partially bounding the opening, and at least one tool receiving section. The connecting member can removably connect the first frame and the second frame to one another. The gate mechanism can comprise a gate that is pivotably coupled to the frame and that is pivotable relative to the frame to permit access to the opening.

The first and second frame can be configured to receive various tools, including a folding knife that comprises a handle and a blade that is pivotably connected to the handle. The handle can be configured to be removably coupled to the frame on the tool receiving section of the first or second frame. The first and second frames can each be configured with two tool receiving sections. According, the apparatus can receive at least four tools.

In another embodiment, an apparatus comprises a frame, a first electronic device, and a second electronic device. The frame can have an opening, a gate mechanism partially bounding the opening, a first tool receiving section, and a second tool receiving section. The first electronic device can have a display screen and can be configured to be received in the first tool receiving section. The second can be configured to be received in the second tool receiving section. The second electronic device can be configured to be electrically coupled to the first electronic device through the frame when the first and second electronic devices are received in the first and second tool receiving sections, respectively. The gate mechanism can comprise a gate that is pivotably coupled to the frame, with the gate being pivotable relative to the frame to permit access to the opening.

The first and second electronic device can be configured so they can be electrically coupled to one another after removal from the frame. Optionally, the first and second electronic members can comprise a video game system.

In another embodiment, an apparatus can comprise a frame and at least one electronic device. The frame can have an opening, a gate mechanism partially bounding the opening, at least one tool receiving section, and power source. The electronic device can be configured to be received in the tool receiving section. The frame can be configured to provide electrical power to the electronic device via the power source when the electronic device is received in the at least one tool receiving section. The gate mechanism can comprise a gate that is pivotably coupled to the frame and that is pivotable relative to the frame to permit access to the opening.

The frame can further comprise a hand-crank configured to generate power to the power source. In addition, the frame can further comprise a line-out, with the line-out being configured to receive an electrical input and to provide power from the power source to an external electronic device via the electrical input.

The foregoing and other objects, features, and advantages of the invention will become more apparent from the following detailed description, which proceeds with reference to the accompanying figures.

BRIEF DESCRIPTION OF THE DRAWINGS

FIG. 25B is a side view of the apparatus shown in FIG. 25A.

FIG. 28 is a bottom view of the apparatus shown in FIG. 25A.

FIG. 29 is a top view of the apparatus shown in FIG. 25A.

FIG. 30 is a left side view of the apparatus shown in FIG. 25A.

FIG. 31 is a right side view of the apparatus shown in FIG. 25A.

FIG. 32 is a perspective view of the frame of the apparatus shown in FIG. 25A.

DETAILED DESCRIPTION

The present disclosure concerns embodiments of a multi-purpose tool comprising one or more tools that are configured to removably mount to a frame. The frame desirably has at least one opening and a gate to permit access to the opening.

Figure 1:
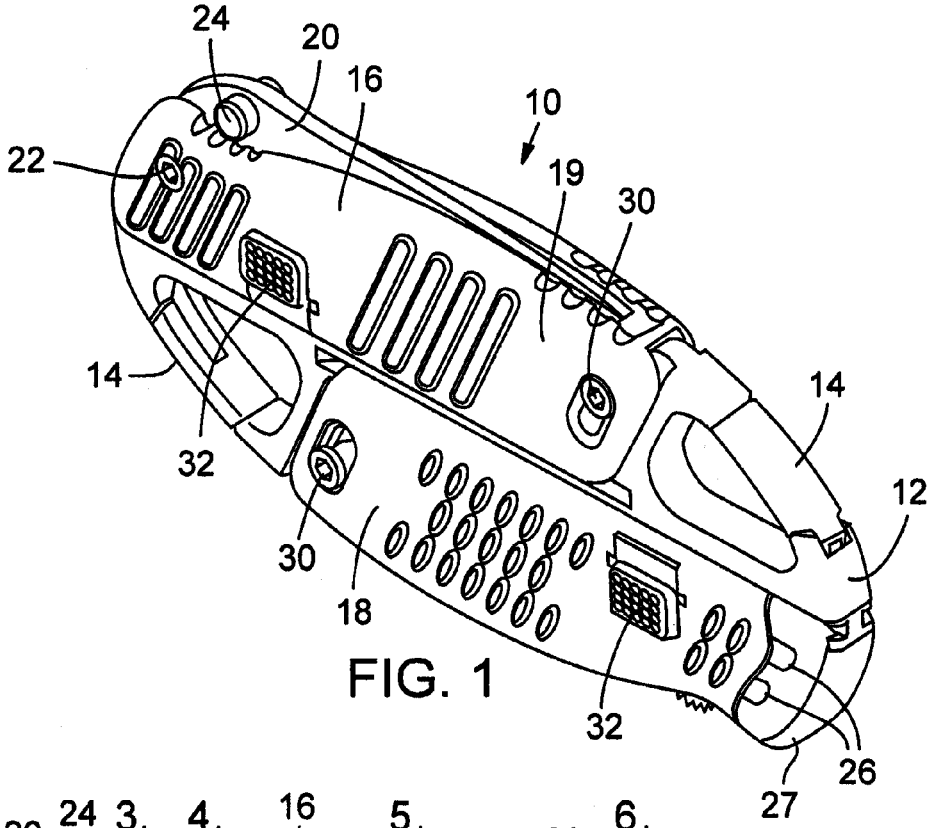
FIG. 1 is a perspective view of an embodiment of an apparatus having a folding knife and a light source attached to a frame.
Figure 2:
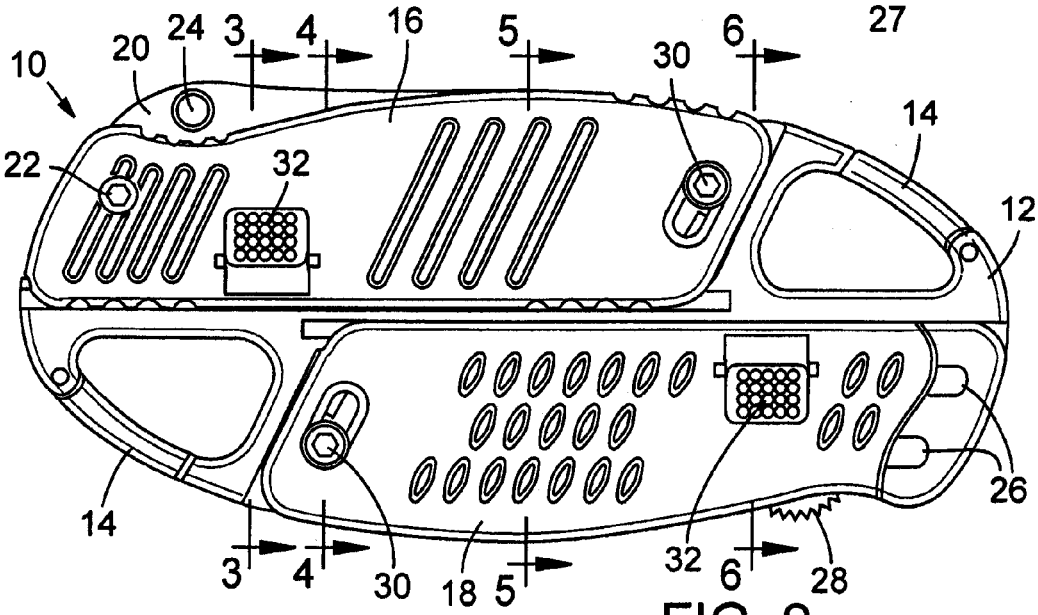
FIG. 2 is a side view of the apparatus of FIG. 1.

FIGS. 1 and 2 show an apparatus 10, according to one embodiment, having a frame 12 with two gate mechanisms 14. Frame 12 has two tools attached to it, namely, a folding knife tool 16 and a light tool 18 in the illustrated embodiment. Folding knife tool 16 has a folding knife blade 20 that is connected to a handle portion 19 by a pivot mechanism 22. The pivot mechanism desirably comprises a pivot pin and pivot screw, as known in the art. The blade 20 can include a thumb stud 24 on both sides of the blade 20 to facilitate opening the blade 20 from a closed position. The blade 20 can be pivoted between a closed position (as shown in FIG. 1) and an open position extending from the handle portion 19, like a conventional folding knife. Various other tools can be mounted to frame 12, as further described below.

Light tool 18 can have two LED elements 26 which are connected to a battery source (not shown) contained within the body of light tool. The LED elements 26 are activated by rotating a light activator switch 28, which causes power to be supplied by the batteries to the LED elements 26. The batteries can be electrically connected to and can supply power to the LED elements in any conventional manner. The tool 18 can have a transparent cover 27 covering LED elements 26. In alternative embodiments, conventional incandescent bulbs can be used instead of LED elements 26. The number of LED elements 26 can vary and, if desired, the LED elements 26 can be operated (turned on) as a group and/or individually.

Figure 2A:
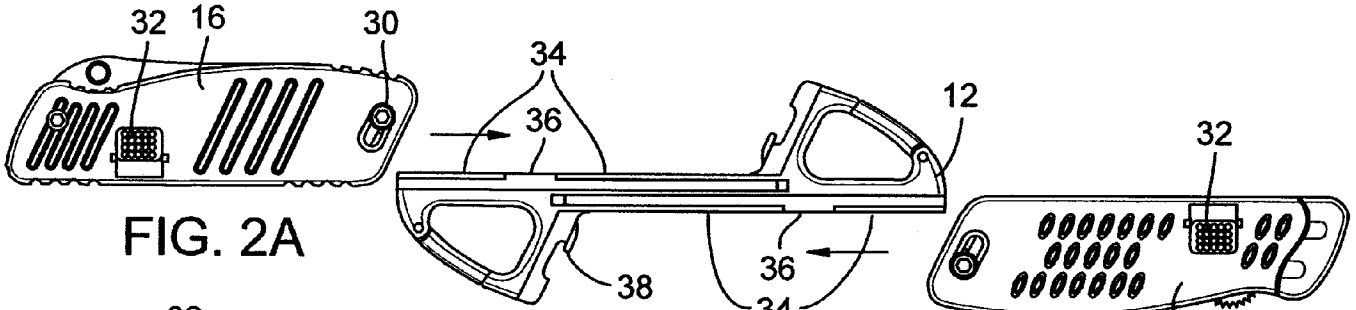
FIG. 2A is an exploded view of the apparatus of FIG. 1.
Figure 2B:
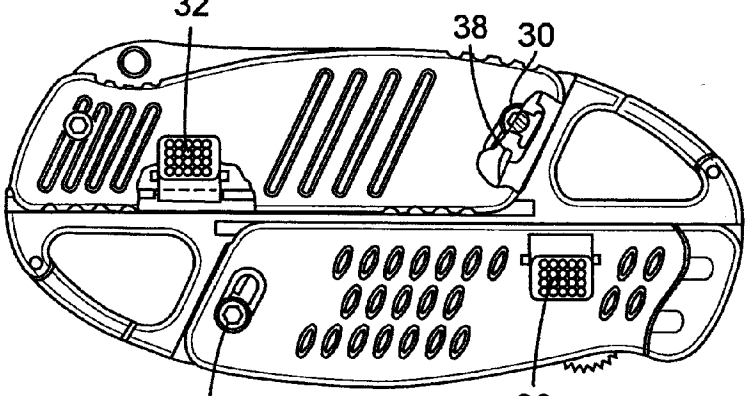
FIG. 2B is a side view of the apparatus of FIG. 1, shown with a section broken-away to depict a locking mechanism of the folding knife in an unlocked position.
Figure 2C:
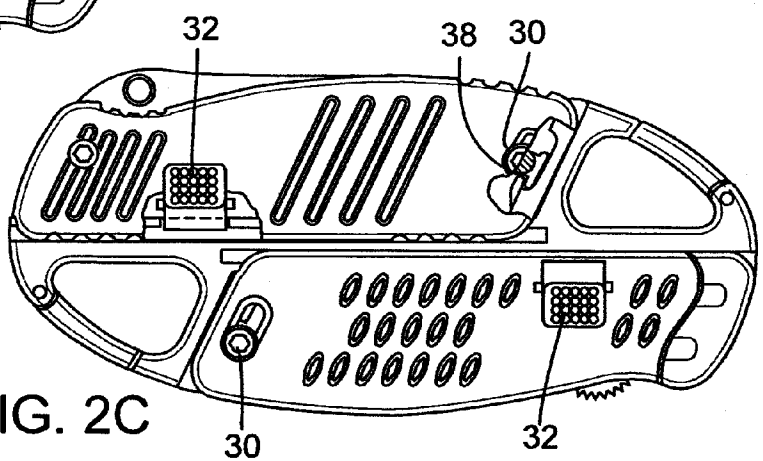
FIG. 2C is a side view of the apparatus of FIG. 1, shown with a section broken-away to depict the locking mechanism in a locked position.

Each of the tools 16, 18 can have a latch mechanism, such a sliding latch mechanism 30 and/or a rocker latch mechanism 32, to retain the tool on the frame. Referring now to FIGS. 2A, 2B, and 2C, sliding latch mechanism 30 is manually moved up and down to lock or release a tool from the frame 12. Rocker latch mechanism 32, on the other hand, automatically locks a tool onto frame 12. To release rocker latch mechanism 32 so that the tool can be removed from the frame 12, pressure is exerted against the sides of the rocker latch mechanism 32.

Figure 7:
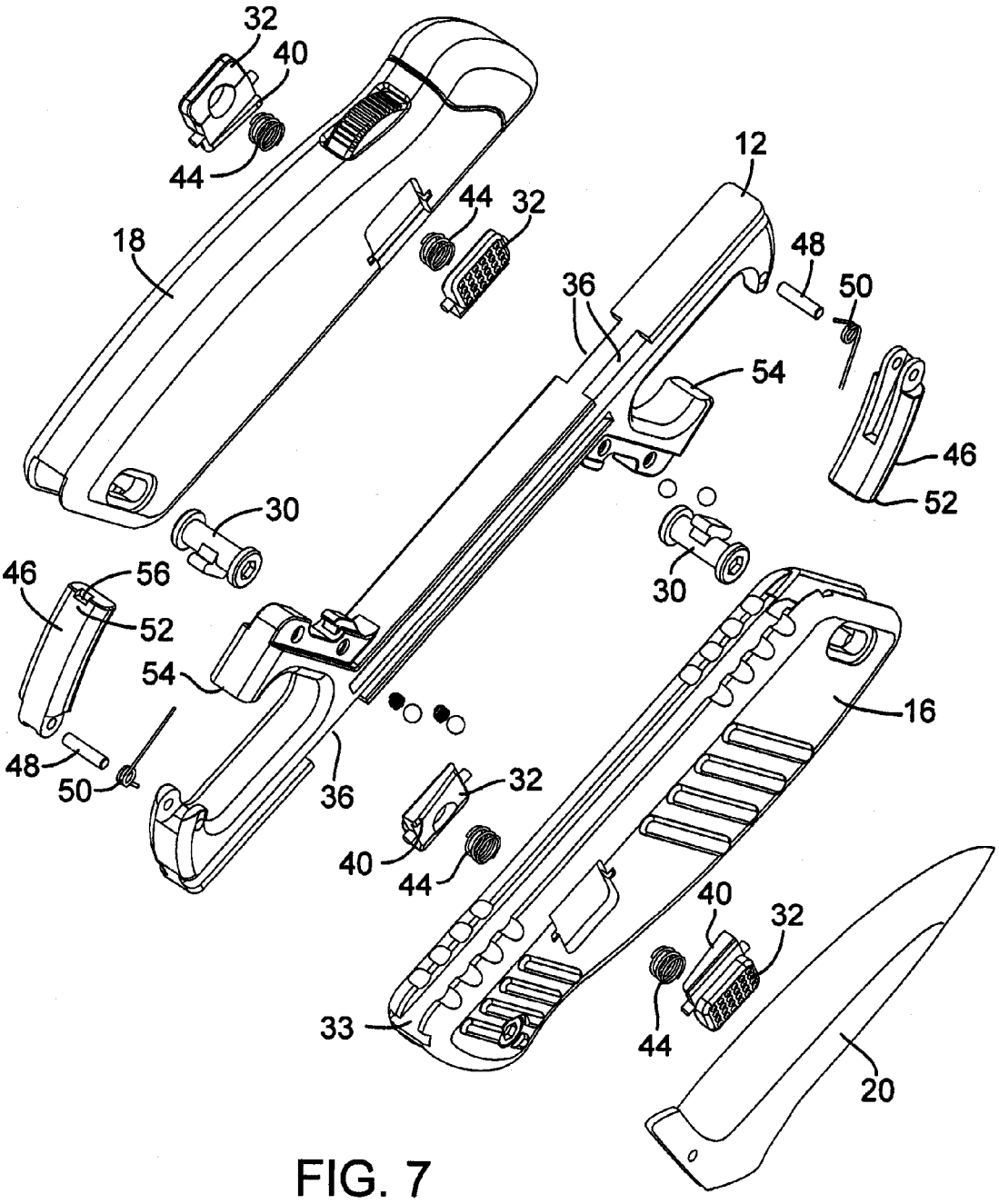
FIG. 7 is a simplified, exploded view of the apparatus of FIG. 1.
Figure 8:
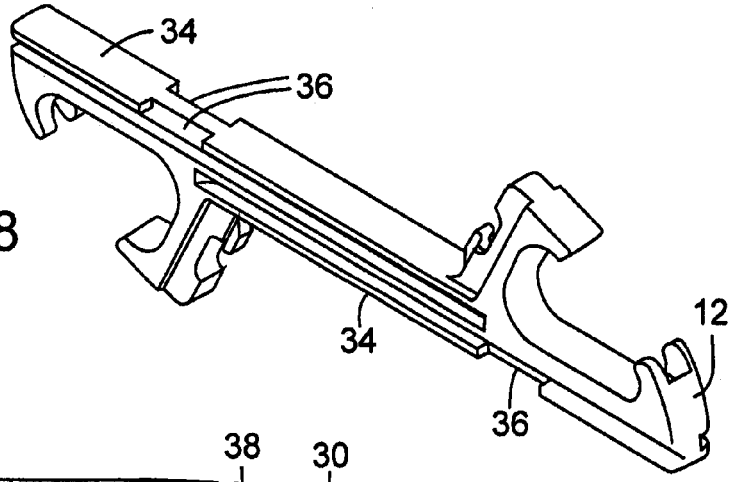
FIG. 8 is a perspective view of a frame that can be used in the embodiment of FIG. 1.

As shown in FIG. 2A, knife tool 16 and light tool 18 each have a rail receiving area, or elongated slot, 33 (shown in FIG. 7) that receives a corresponding rail 34 when a tool is attached to frame 12. On both sides of the frame 12, there can be discontinuous gaps 36 in rails 34. FIGS. 7 and 8 show frame 12 and gaps 36 in the rails 34. When sliding a tool onto frame 12, the tool is directed so that rail receiving area 33 aligns with rail 34. The tool is then slid across the frame, with rail 34 entering into the rail receiving area 33.

Moreover, it will be understood that the connection of the tool to the frame can be reversed from that shown. That is, the frame can comprise a slot and the tool can comprise a complementary rail.

The biasing of the rocker latch mechanism 32 operates to automatically secure the tool in place when the rocker latch mechanism 32 reaches gaps 36. As shown in FIG. 7, rocker latch mechanism 32 has inwardly latching portions 40 on each side. When a tool slides along rail 34, the latching portions 40 eventually reach and align with gaps 36. At that point, the inward biasing of rocker latch mechanism 32 causes latching portions 40 to enter gaps 36 and lock the tool in place on the frame. FIGS. 2B and 2C show a cutaway of the area around the rocker latch mechanism 32 to illustrate the alignment and locking action of rocker latch mechanism 32 with gaps 36.

Figure 3:
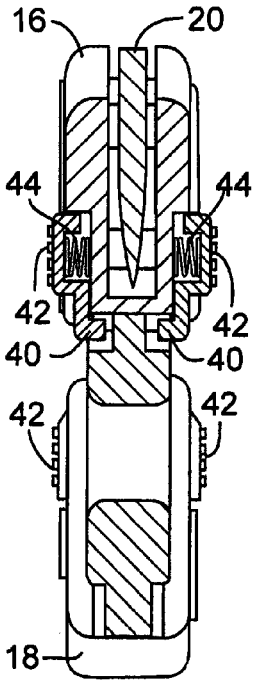
FIG. 3 is a cross-sectional view taken along line 3-3 of FIG. 1.
Figure 4:
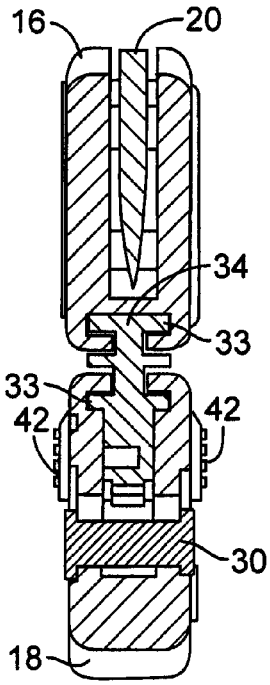
FIG. 4 is a cross-sectional view taken along line 4-4 of FIG. 1.

FIGS. 3-6 are cross-sectional views that show rocker latch mechanism 32 in more detail. As discussed above, latching portion 40 locks in place in gaps 36 formed in rails 34 of frame 12. To release latching portion 40 from the frame, pressure is exerted against side 42 of rocker latch mechanism 32. Springs 44 located behind the side of rocker latching mechanism 32 resist the opening pressure and ensure that latching portion 40 engages frame 12 with sufficient force. If sufficient pressure is applied to side 42 of the rocker latch mechanism, latching portion 40 moves, or pivots in a rocking action, outward, releasing the grip on frame 12 and permitting the tool to be removed from frame 12. As shown in FIG. 3, a latch mechanism 32 desirably is provided on each side of a tool so that both latch mechanisms 32 are pressed inwardly at the same time to permit removal of the tool.

Figure 5:
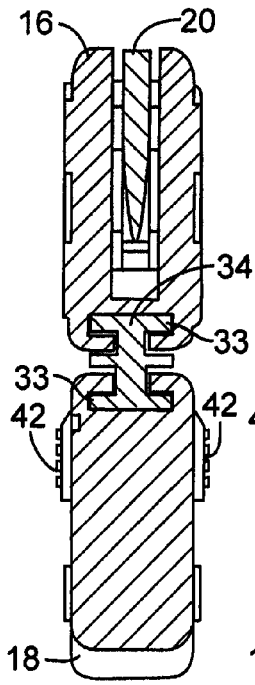
FIG. 5 is a cross-sectional view taken along line 5-5 of FIG. 1.
Figure 6:
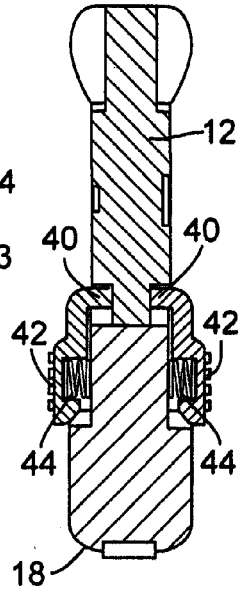
FIG. 6 is a cross-sectional view taken along line 6-6 of FIG. 1.

As shown in FIG. 5, each of the two rails 34 is substantially T-shaped, with the bottom rail 34 forming an inverted T-shape. Although the rails can be T-shaped, they could also be formed in other shapes so long as that shape corresponds with a slot or opening in the rail receiving area of the corresponding tool. For example, a rail could be formed of a simpler shape, such as an L-shape, or the shape of a rail can be more complex, such as a spine with rounded or otherwise varying edges. If there are two or more rails on a frame, the rails could be different from one another, so that each rail is not capable of receiving the same tools. Desirably, however, multiple rails on one frame are similarly shaped, so that a tool of the apparatus is fully interchangeable and can fit on any rail on the frame.

Sliding latch mechanism 30 can be used to further secure the tools to the frame. FIG. 2B shows sliding latch mechanism 30 in the unlocked position and FIG. 2C shows sliding latch mechanism 30 in the locked position. As shown in those figures, sliding latch mechanism 30 has a portion that, when locked, extends underneath a lip 38 in the frame 12 so that the tool cannot move laterally along the rail 34.

Figure 9A:
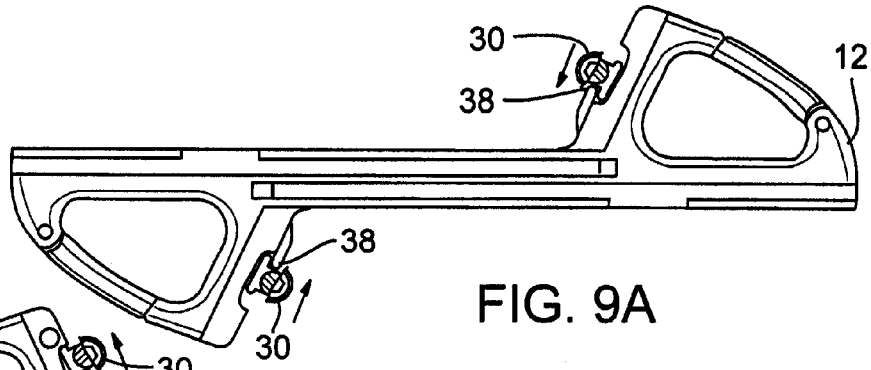
FIG. 9A is a side view of the frame of FIG. 8, shown with a locking member in a locked position.
Figure 9B:
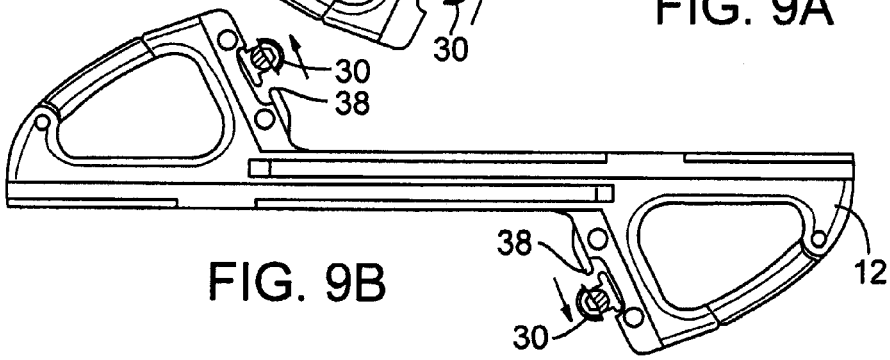
FIG. 9B is a side view of the frame of FIG. 8, shown with a locking member in an unlocked position.
Figure 10:
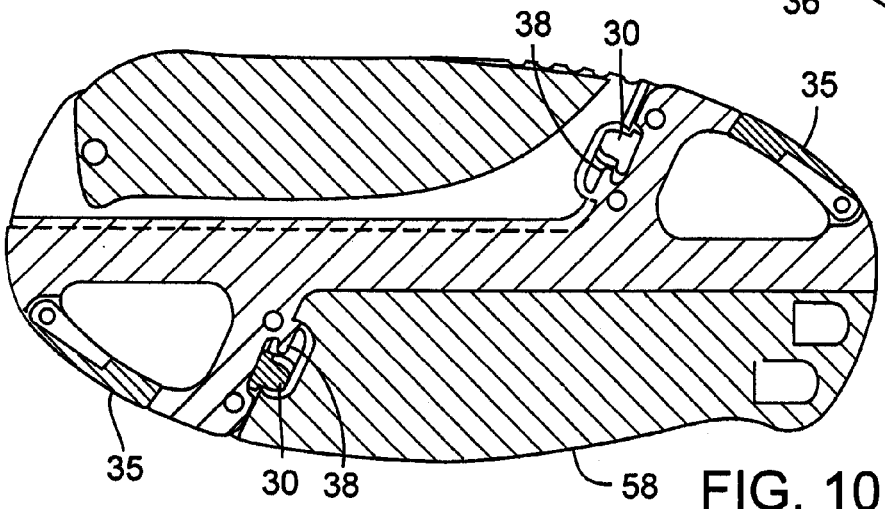
FIG. 10 is a cross-sectional view of the apparatus of FIG. 1, showing an embodiment of a locking mechanism.

FIGS. 9A, 9B, and 10 show additional details relating to the sliding latch mechanism. FIGS. 9A and 9B show just frame 12 and sliding latch mechanism 30. In those figures, for clarity, sliding latch mechanism 30 is shown without any other part of the tool to which it is actually connected. FIG. 9A depicts sliding latch mechanism 30 in the locked position, and FIG. 9B depicts sliding latch mechanism 30 in the unlocked position. FIG. 10 is a cross-sectional view of the apparatus shown in FIG. 1. In this cross-sectional view, the sliding latch mechanism 30 is shown in the unlocked position.

Referring to FIG. 7, gate mechanism 14 is discussed in more detail. Each gate mechanism 14 can comprise a gate 46 and a gate pin 48. Gate pin 48 attaches the gate 46 to the frame 12. Gate 46 is desirably outwardly biased by a torsion spring 50 or other biasing mechanism. When no external force is acting on gate 46, distal end 52 of the gate 46 contacts a gate stopping portion 54 of frame 12 that extends toward the gate 46. This contact between gate stopping portion 54 and gate 46 prevents gate 46 from extending outwardly beyond gate stopping portion 30. Desirably, distal end 52 of gate 46 has a notched section 56 that corresponds to the gate stopping portion 54 so that the two elements mate together. In use, when pressure is applied inwardly on the gate 46, it swings open about gate pin 48 to the opening bounded by the gate and portions of the frame. This springing gate mechanism permits frame 12 to be attached to a clip, loop, or other suitable structure.

The gate mechanism discussed above is generally similar to a standard gate used in a carabiner tool. The structure and shape of the gate mechanism could vary from that disclosed above, and could be any conventional type of gate mechanism. The gate mechanism can also comprise a gate that is movably coupled to the frame but which does not pivot. For example, the gate could be a plunger-style gate.

The opening formed by the gate mechanism disclosed in FIGS. 1 and 2 is generally D-shaped. Alternatively, the opening can be round, oval, pear-shaped, or any other shape. Moreover, the gate itself need not be curved as shown in FIGS. 1 and 2. The gate could instead be straight. In addition, the free end of the gate can simply be blocked by the gate stopping portion or the free end of the gate can be configured to fit inside or otherwise mate with the gate stopping section.

The gate mechanism also need not include a torsion spring. It could instead be outwardly biased in some other conventional manner. Alternatively, the gate mechanism need not be biased at all. Instead, it could simply include a locking mechanism to lock the gate in place. For example, a sleeve on the gate could include a screw lock which could be used to lock the gate against the frame by manually twisting the sleeve across a section of the frame. Of course, a locking mechanism of this sort could also be used along with the biasing mechanism.

Figure 11:
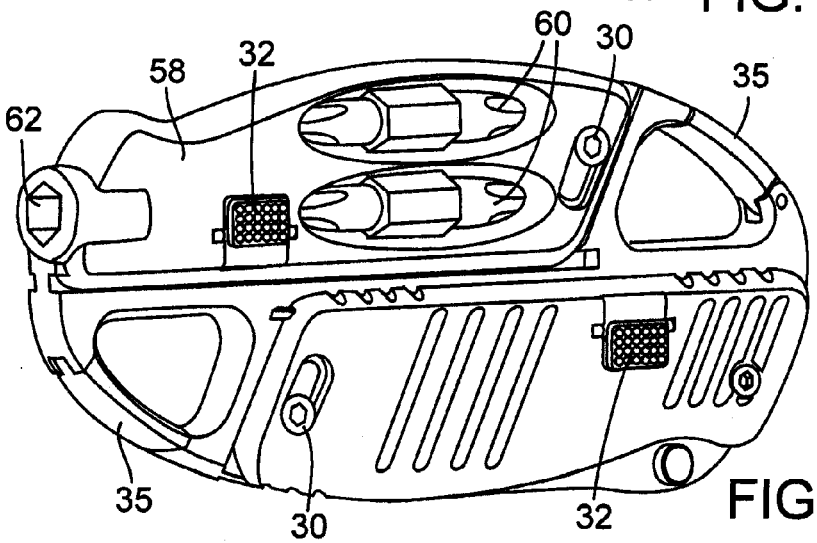
FIG. 11 is a perspective view of an apparatus having a folding knife and a screwdriver tool attached to a frame, according to another embodiment.

FIG. 11 shows another embodiment of an apparatus having one or more tools. In this embodiment, screwdriver tool, or screwdriver, 58 is shown attached to frame 12 along with knife tool 16. Screwdriver tool 58 includes two double-ended bits 60 (although various other types of bits can be provided) and a bit-receiving opening 62 at one end of the tool body. As shown in FIG. 11, double-ended bits 60 can be held in a recessed storage area on the side of tool 58. Tool 58 can be attached to and removed from frame 12 in the same manner as the other tools discussed above. For example, tool 58 can include a sliding latch mechanism 30 and a rocker latch mechanism 32 as discussed above. Frame 12 can include two gate mechanisms 35 of the type discussed above.

Figure 12:
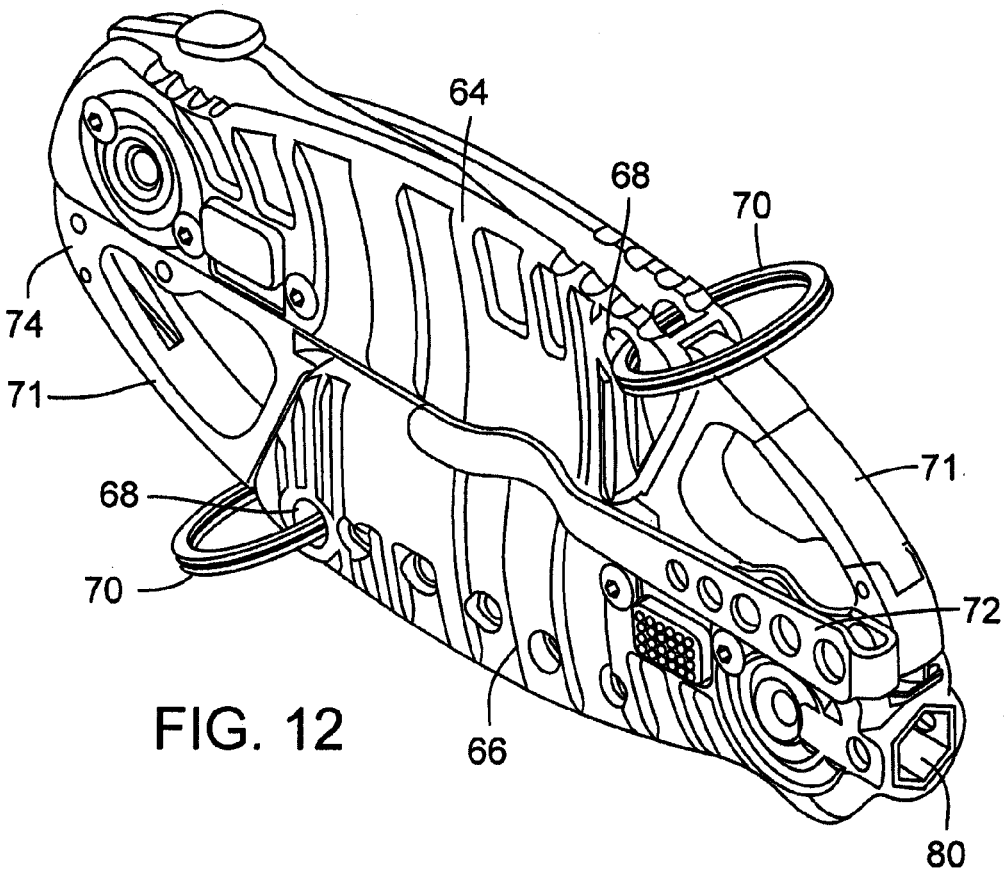
FIG. 12 is a perspective view of an apparatus shown with a folding knife and a screwdriver tool attached to a frame, according to another embodiment.
Figure 13:
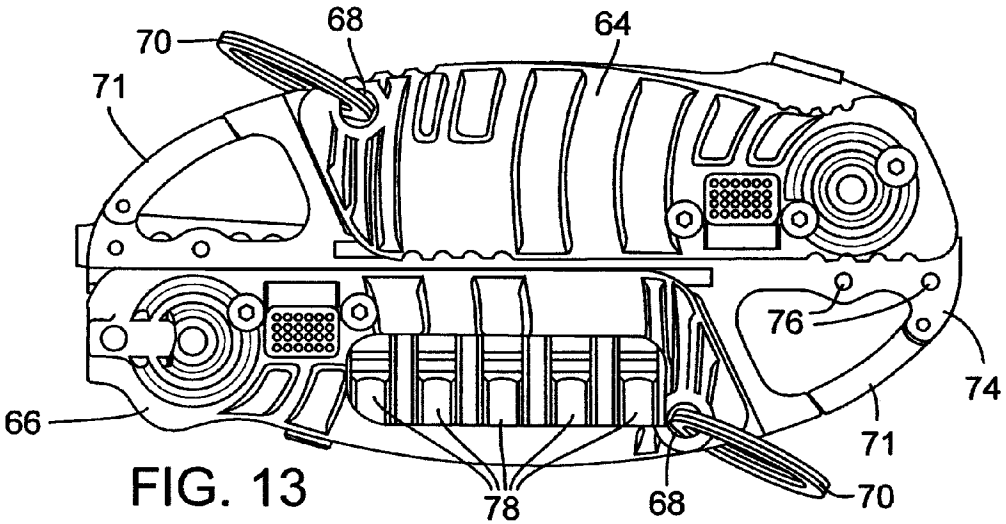
FIG. 13 is a side view of the apparatus shown in FIG. 12.

FIG. 12 shows yet another embodiment. In this embodiment, knife tool 64 and screwdriver tool 66 each have a key ring opening 68 with a key ring 70 attached thereto. A belt clip 72 can be attached to frame 74. As shown in FIG. 13, frame 74 includes openings 76 to which belt clip 72 can be attached. Belt clip 72 desirably attaches to frame 74 by a snap fit connection. However, belt clip 72 could be attached by any conventional mechanical method, such as screws. Frame 74 can include two gate mechanisms 71 of the type discussed above.

Figure 14:
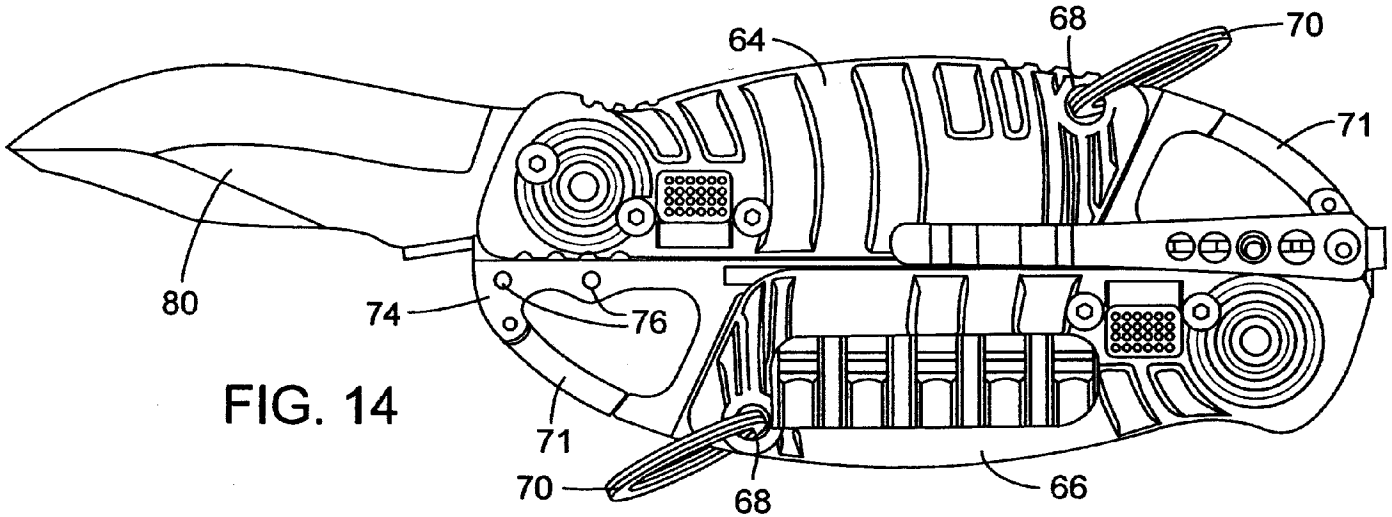
FIG. 14 is a side view of an embodiment of an apparatus having a folding knife and light source.
Figure 15:
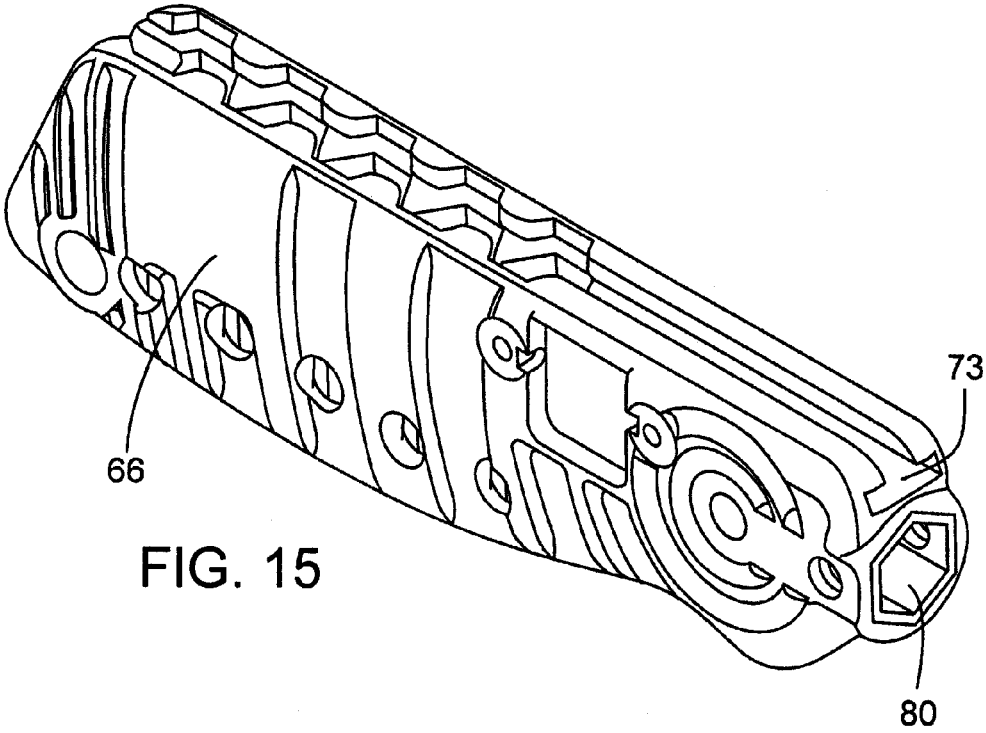
FIG. 15 is a perspective view of the screwdriver tool of FIG. 12.
Figure 16:
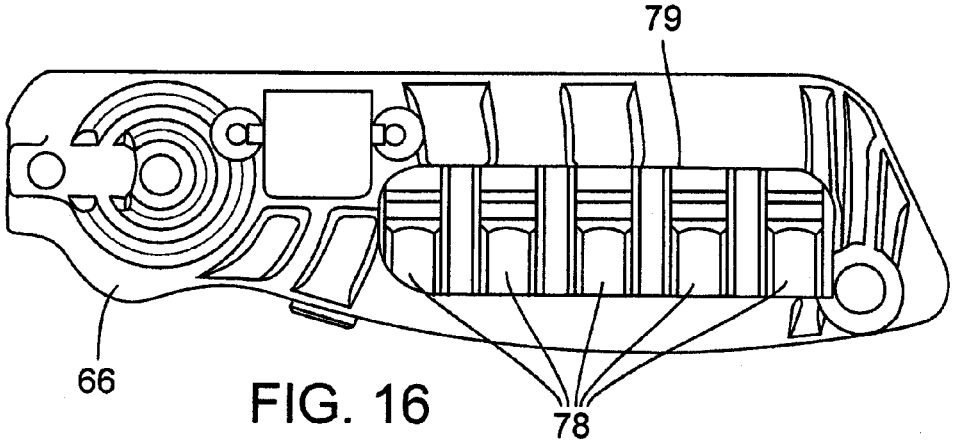
FIG. 16 is a side view of the tool of FIG. 15.

FIG. 13 shows a side view of the apparatus shown in FIG. 12. In particular, FIG. 13 shows screwdriver tool 66 with a five internal bit storage areas 78 for holding screwdriver bits. Bit storage areas 78 are accessible through window 79, so that bits 60 can be slid out of bit storage areas 78 through an opening on the side of tool 66 that is opposite the frame attachment side. Therefore, the bits can be accessed without removal of the tool from the frame. Bits can be removed from storage areas 78 and inserted into a bit receiving area 80. FIG. 14 shows knife tool 64 with a blade 82 in an open, extended position. Knife tool 64 may include a locking mechanism (not shown) to hold blade 82 securely in the open position. FIGS. 15 and 16 show screwdriver tool 66 removed from frame 74. FIG. 15 shows rail receiving area 73, which receives the rails of frame 74 when attaching screwdriver tool 66 to frame 74.

Figure 17:
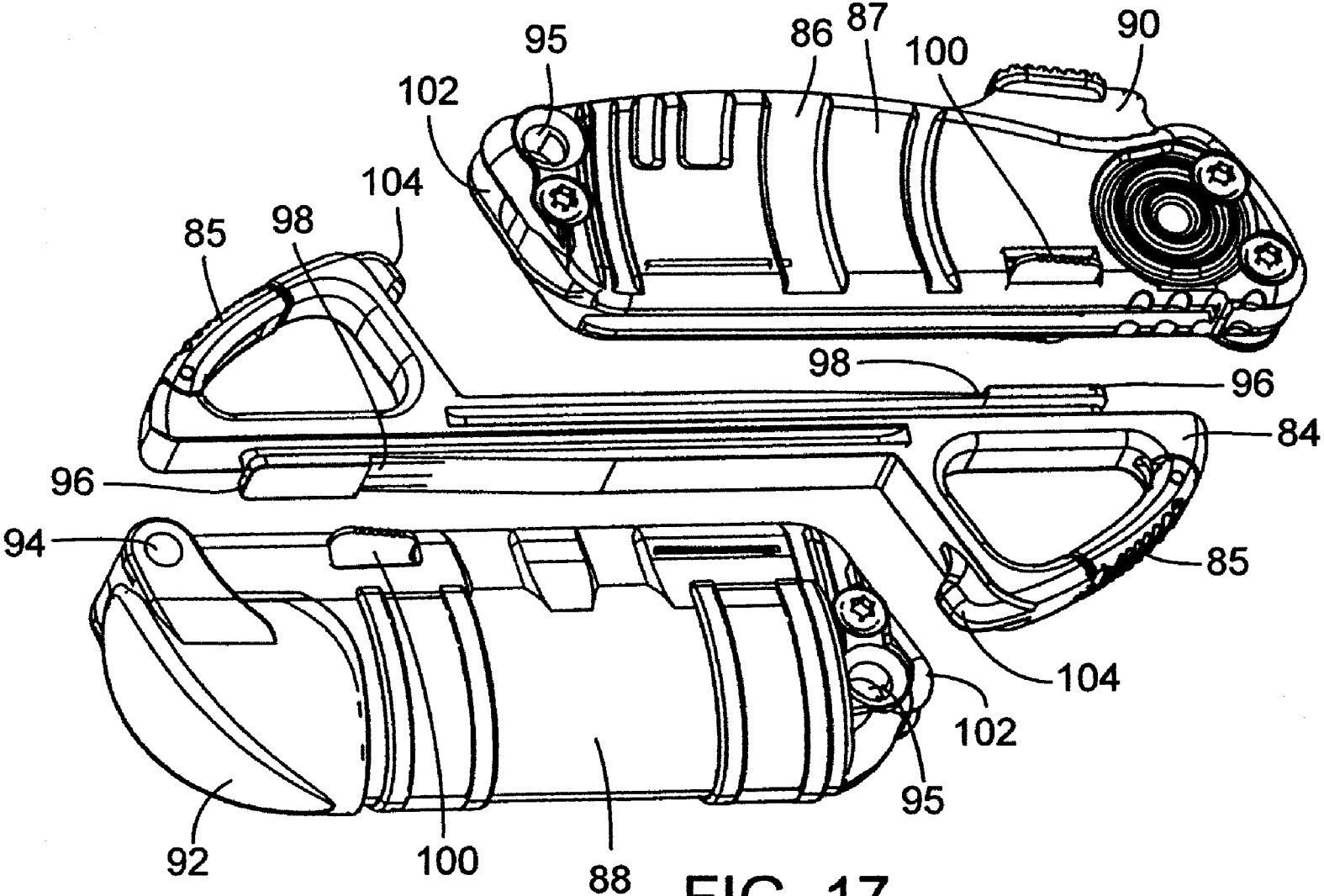
FIG. 17 is an exploded view of an embodiment showing an apparatus with a folding knife and a lighter holder.
Figure 18:
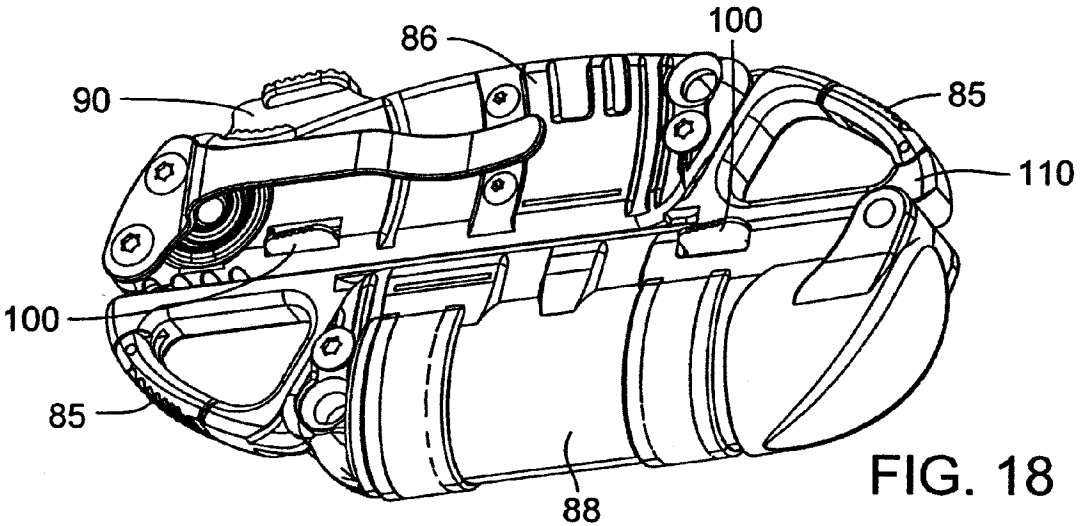
FIG. 18 is a perspective view of an embodiment showing an apparatus with a folding knife and a light source.
Figure 19:
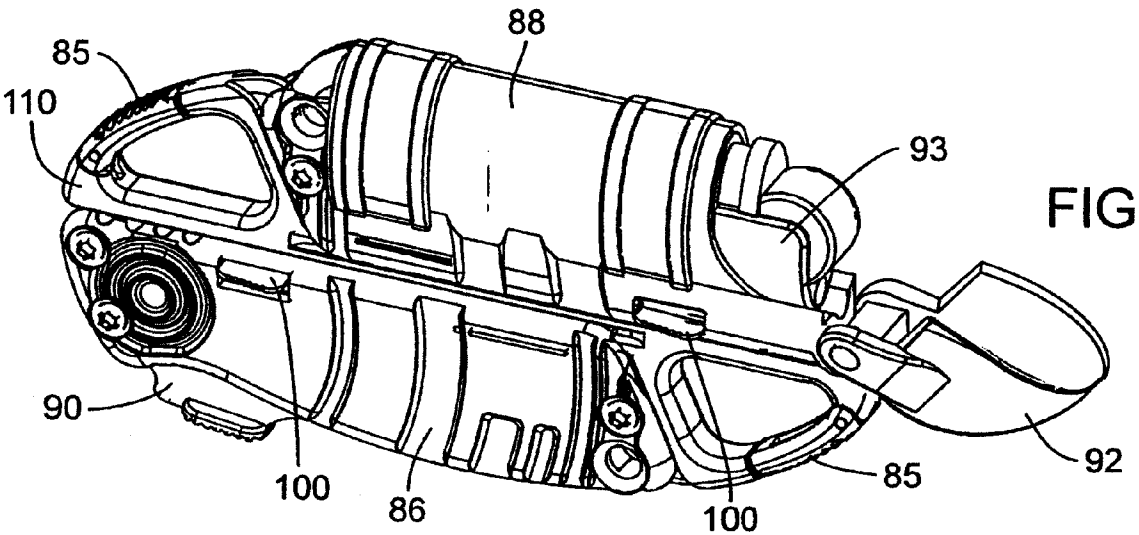
FIG. 19 is a perspective view of the apparatus shown in FIG. 17.

FIGS. 17-19 show yet another embodiment. FIG. 17 shows an exploded view of a frame 84, knife tool 86, and a container tool 88. Frame 84 has two gate mechanisms 85. Knife tool 86 comprises a blade 90 that is pivotably attached to a handle 87. Container tool 88 has a lid 92 that pivots about lid pin 94. When lid 92 is closed, it desirably makes a water tight seal with the body of container tool 88.

The container tool 88 is desirably sized to accommodate a traditional lighter, such as a BIC™ lighter. In FIG. 19, lid 92 is shown in an open position, revealing a lighter 93 inside the container tool 88. Of course, the container could be made larger or smaller to hold various other items, such as prescription medicine pill bottles or other useful items. The knife tool 86 and the container tool 88 can also have openings 95 for attachment of a key ring.

Knife tool 86 and container tool 88 attach to frame 84 in a different manner than the tools previously described. Tools 86 and 88 have openings or slots along a bottom section of those tools and these openings mate with rails 96 of the frame 84. The height of rails 96 varies along the length of the frame. In particular, there is a sharp drop in height at one end creating a wall 98 along the top of rails 96. Each of the tools 86, 88 have a cantilever latch spring 100 that is biased downward. When attaching a tool 86, 88 to frame 84, the tool slides along the frame until the end of the cantilever latch spring 100 moves beyond the high point of the rails 96 and drops down against wall 98. At that point the biased cantilever latch spring 100 prevents the tool from being removed from the frame longitudinally. In addition, each tool has an indentation 102 at its forward end that receives a projection 104 of the frame 84. When the tool slides onto frame 84, the indentation 102 and the projection 104 mate so that the tool is further secured to the frame 84.

Figure 20:
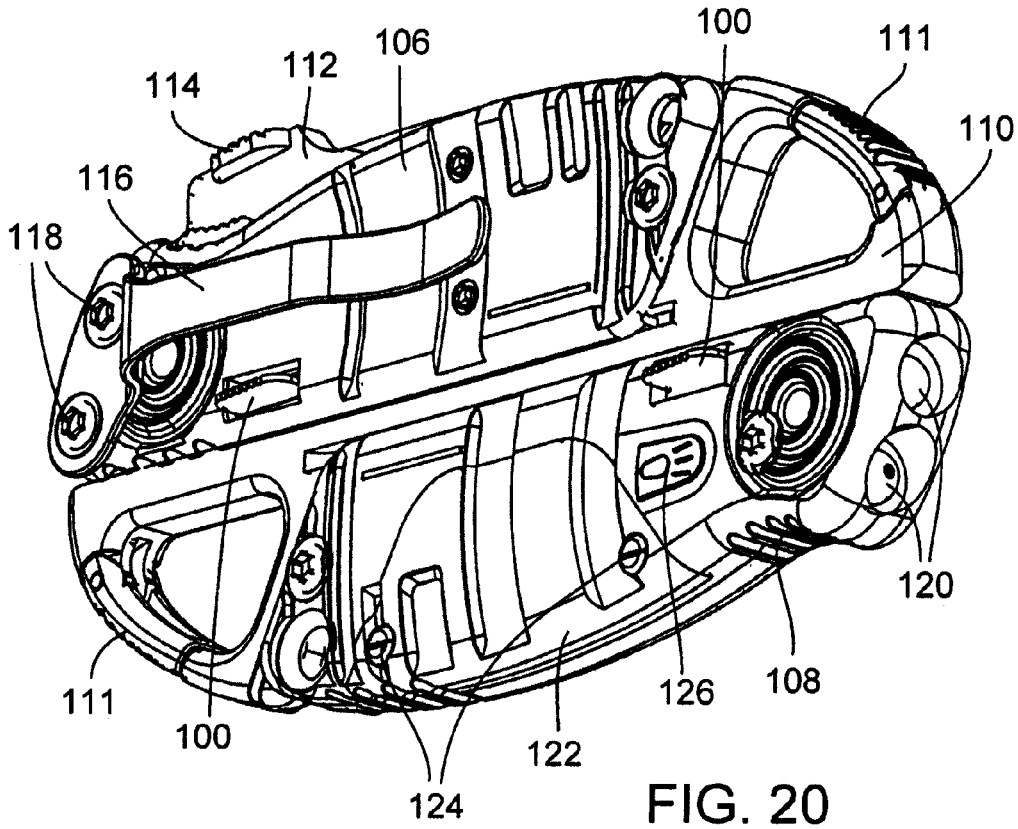
FIG. 20 is a perspective view of the apparatus shown in FIG. 17, shown with a lighter holder cap in an open position.

FIG. 20 shows yet another embodiment. A knife tool 106 and a light tool 108 are attached to a frame 110. Frame 110 has two gate mechanisms 111. Blade 112 is pivotably attached to knife tool 106 by a pivoting mechanism (not shown). Blade 112 can include a thumb stud 114 to facilitate opening and closing of the blade. In addition, knife tool 106 may have a belt clip 116 attached thereto. In FIG. 20, belt clip 116 is shown screwed to the knife tool 106 by screws 118. Alternatively, belt clip 116 could be attached to either the knife tool 106 or the frame 110 by other known methods of attachment.

Light tool 108 includes two LED elements 120 and a battery source (not shown) that provides current to the LED elements. The battery source is desirably accessible under a battery cover 122, which is shown attached to the light tool by screws 124. The LED elements 120 can be activated by any known method, such as by pressing a push button switch 126.

Figure 21:
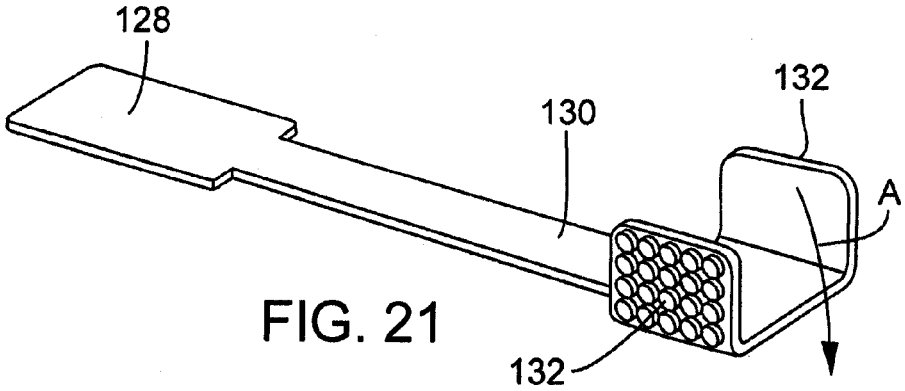
FIG. 21 is a perspective view of a cantilever spring locking mechanism.

Knife tool 106 and light tool 108 can be attached to the frame 110 in the same manner as discussed above with the tools and frame shown in FIG. 17. Cantilever latch spring 100 is shown in more detail in FIG. 21. Cantilever latch spring 100 has a fixed end 128 and a free end 130. Fixed end 128 is secured to the removable tool by any mechanical means. Free end 130 is biased downward in the direction A. Accordingly, the free end 130 of the cantilever latch spring 100 presses downward and locks the tool in place when the tool slides onto a frame in the manner discussed above. Cantilever latch spring 100 can also have two gripping members 132 so the free end 130 can be manually lifted upward to release the cantilever latch spring and remove the tool from the frame.

Figure 22:
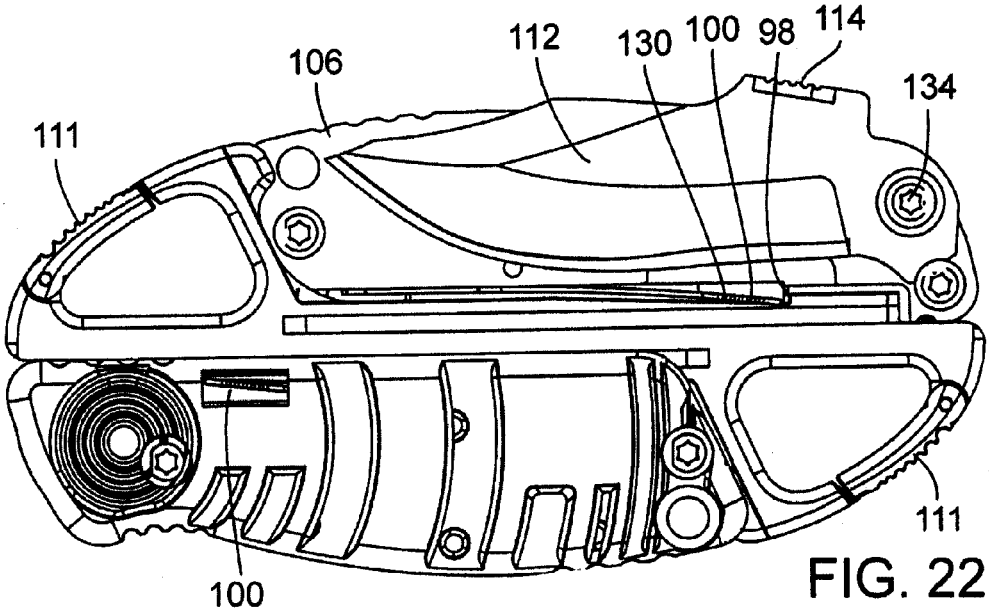
FIG. 22 is a side view of the apparatus shown in FIG. 18, shown with portions of the apparatus removed.
Figure 23:
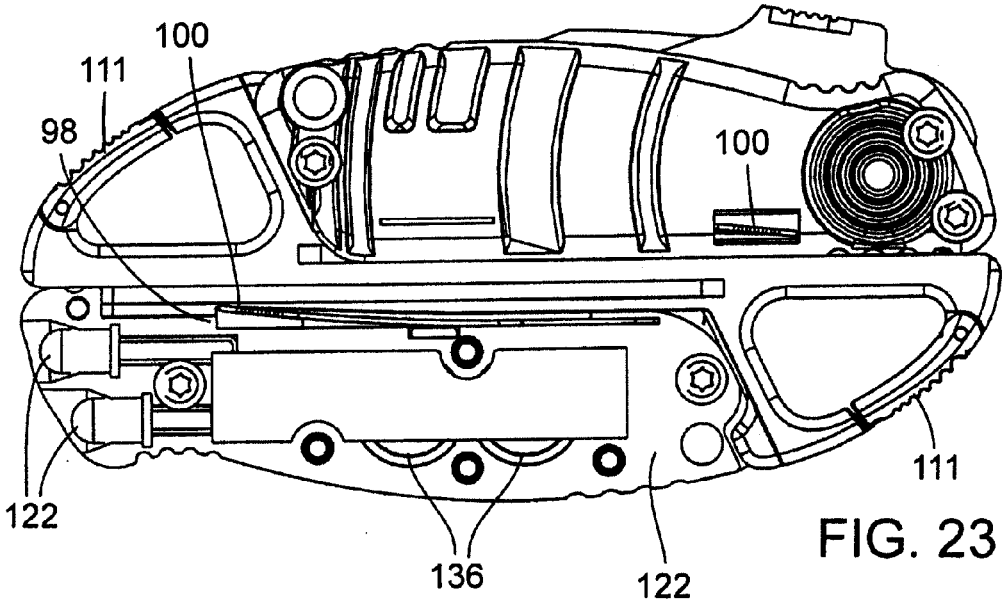
FIG. 23 is another side view of the apparatus shown in FIG. 18, shown with portions of the apparatus removed.

FIGS. 22 and 23 show additional views of the apparatus of FIG. 20, with various sections of the apparatus removed for clarity. FIG. 22 shows knife tool 106 with one side removed, thereby exposing blade 112. Blade 112 has a thumb stud 114 and is pivotably attached to knife tool 106 through pivot mechanism 134, which is desirably a pivot pin and pivot screw assembly. Cantilever latch spring 100 is shown biased downward in the locked position with the free end of the cantilever latch spring 100 adjacent the wall 98 of rail 96, which prevents removal of the tool 106 in the longitudinal direction (in the direction of arrow B in FIG. 22). The tool can be removed from the frame by lifting the free end 130 upwardly away from the rail until the free end clears wall 98, at which point the tool can be slid off the rail in the direction of arrow B.

FIG. 23 shows light tool 122 with one side removed, thereby exposing two batteries 136 contained within light tool 122. LED elements 122 are electrically connected to batteries 136, which provide the energy necessary to power LED elements 122. Again, cantilever latch spring 100 is shown biased downward in the locked position with the free end of the cantilever latch spring 100 adjacent the wall 98 of rail 96.

Figure 24:
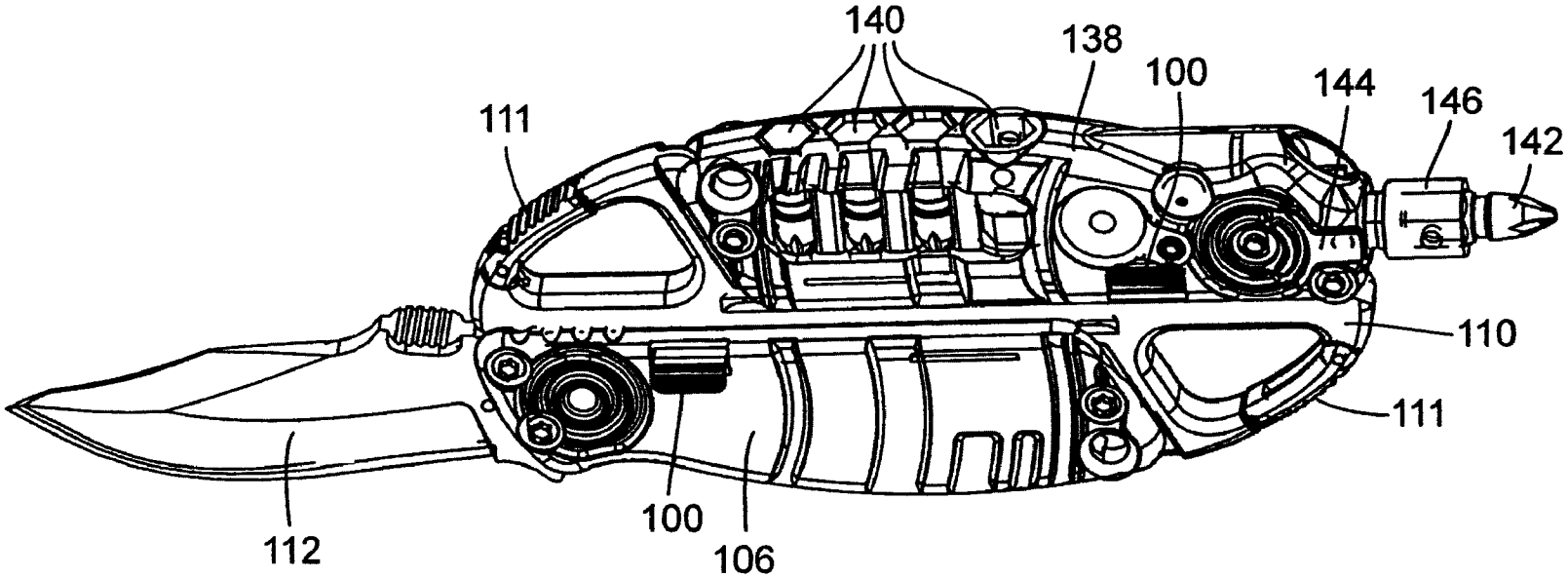
FIG. 24 is a perspective view of an embodiment showing an apparatus with a folding knife and a screwdriver tool.

FIG. 24 shows yet another embodiment. FIG. 24 shows frame 110 with knife tool 106 and screwdriver tool 138 attached thereto. Frame 110 has two gate mechanisms 111. Knife tool 106 is shown with blade 112 pivoted into an open position for use. The knife tool can have a conventional liner lock that engages the tang of the blade when it is pivoted to the open position to protect against inadvertent closing of the blade. Screwdriver tool 138 is shown with a side area removed to expose four bit holding areas 140. Bit holding areas 140 are accessible to a user from a side of screwdriver tool 138 and extend into the body of screwdriver tool 138. Screwdriver tool 138 is shown with a bit 142 and bit driver 146, which is inserted into bit receiving area 144. In addition, one or more of the bit holding areas 140 (such as the rightmost bit holding area 140 shown in FIG. 24) can be configured to function as a bit receiving area. In this manner, a bit 142 can be positioned in a central location along the longitudinal length of the tool, which provides greater leverage (mechanical advantage) to the tool when using one of the bits. Both tools are attached to frame 110 and secured thereto by cantilever latch springs 100.

Figure 25A:
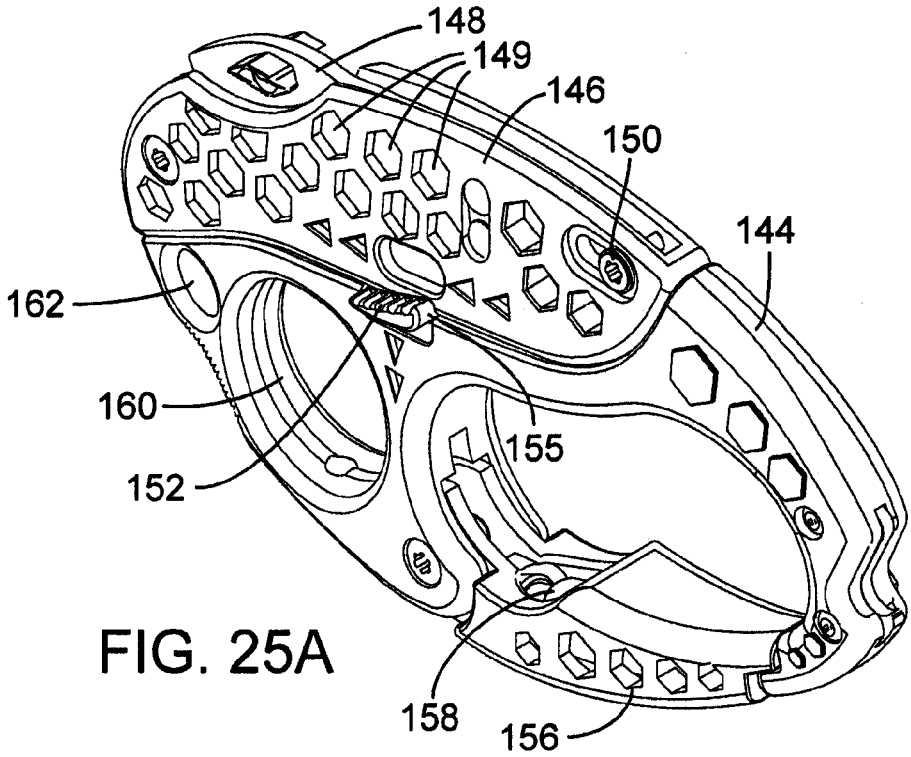
FIG. 25A is a perspective view of an embodiment showing an apparatus with a folding knife.

FIGS. 25A and 25B show another embodiment. Frame 144, unlike the previous frames disclosed, has a single tool attached thereto via a rail system. Knife tool 146 has a blade 148 pivotably attached to a handle 149. Knife tool 146 can be secured to frame 144 by a sliding latch mechanism 150 and automatic locking mechanism 152. Sliding latch mechanism 150 can be similar to that discussed above with respect to FIG. 1. Alternatively, sliding latch mechanism 150 can be any conventional mechanical latching mechanism that is capable of locking and unlocking the knife tool 146 from the frame 144 by moving a sliding latch mechanism. Automatic locking mechanism 152 secures knife tool 146 to frame 144 when knife tool 146 is moved into a holding position along frame 144. This embodiment shows automatic locking mechanism 152 as part of frame 144. However, the apparatus could be modified so that the automatic locking mechanism is part of tool 146.

Figure 26:
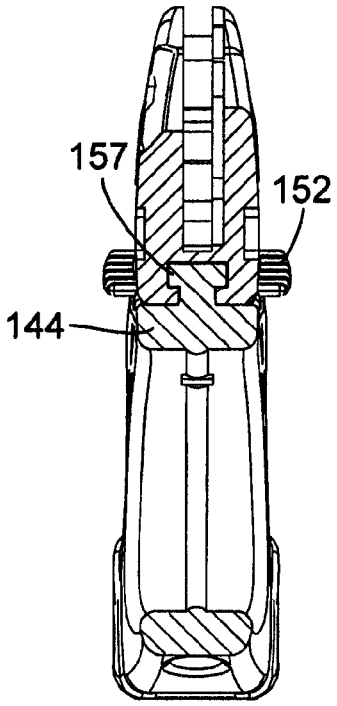
FIG. 26 is a cross-sectional view, taken along line 26-26 of FIG. 25B.
Figure 27:
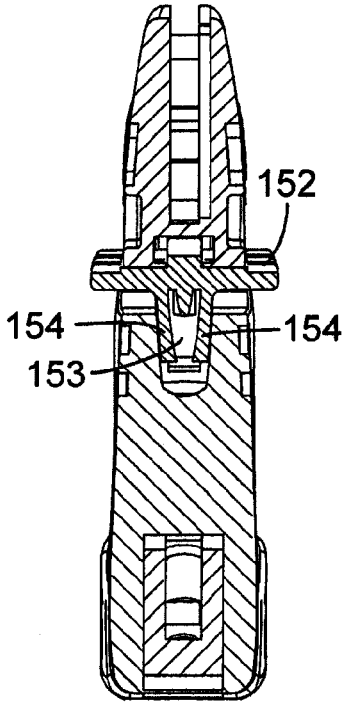
FIG. 27 is a cross-sectional view, taken along line 27-27 of FIG. 25B.

FIGS. 26 and 27 show cross-sectional views of the apparatus of FIG. 25B (which shows the apparatus of FIG. 25A with blade 148 removed for convenience). As shown in FIG. 27, automatic locking mechanism 152 has downwardly extending sections 154 that extend into an opening 153 in the frame. Automatic locking mechanism is biased upward and, when locked, extends into a notch 155 in tool 146. When automatic locking mechanism 152 is in the locked position (as shown in FIG. 27), knife tool 146 cannot move longitudinally along frame 144. When a force is applied downwardly to automatic locking mechanism 152, the automatic locking mechanism 152 moves away from notch 155 permitting knife tool 146 to be moved longitudinally off of frame 144. Automatic locking mechanism 152 is desirably biased upward by the force exerted against the two sides of the downwardly extending sections 154 by the sides the frame that contact those sections. Alternatively, some other type of spring mechanism or mechanical means could be used to bias the automatic locking mechanism 152 upward.

As shown in FIG. 25A, frame 144 has a gate mechanism 156. Gate mechanism 156 can be pivotably attached to the frame in the manner discussed above. In addition, gate mechanism 156 can be hollow and can contain another tool mounted therein. FIG. 25A shows a pen tool 158 contained with gate mechanism 156. Pen tool 158 is desirably pivotably coupled to gate mechanism 156 so that it can be accessed by a user without having to remove pen tool 158 from frame 144. Alternatively pen tool 158 could be entirely removable and secured in gate mechanism 158 by any mechanical means, such as, for example, by snap fitting into place or by using a magnet.

The apparatus of FIGS. 25A and 25B is also shown with a larger aperture 160 and a small aperture 162. Theses apertures are shown empty. However, as discussed in more detail below, these apertures can be shaped to receive additional tools.

FIGS. 28-30 show side, top, and bottom views of the apparatus of FIG. 25B. FIG. 28 shows a bottom view of the apparatus and, in particular, shows pen tool 158 contained in gate mechanism 156.

FIG. 32 shows frame 144 without automatic locking mechanism 152 and without gate mechanism 156. Frame 144 has a rail 164 that is discontinuous at section 166. Opening 153 is located at discontinuous rail section 166. Opening 153 receives downwardly extending section 154 of automatic locking member 152, which is biased upward. Knife tool 146 has a rail receiving section 157 that has a wall 167 and a gap 169 (shown in FIG. 37) that aligns with the automatic locking member 152 when the knife tool 146 is secured to the frame 144. Frame 144 can also include an extension member 170, which aligns with and mates with a corresponding opening 171 in knife tool 146 (shown in FIG. 37) during attachment of knife tool 146 to frame 144.

Figure 33:
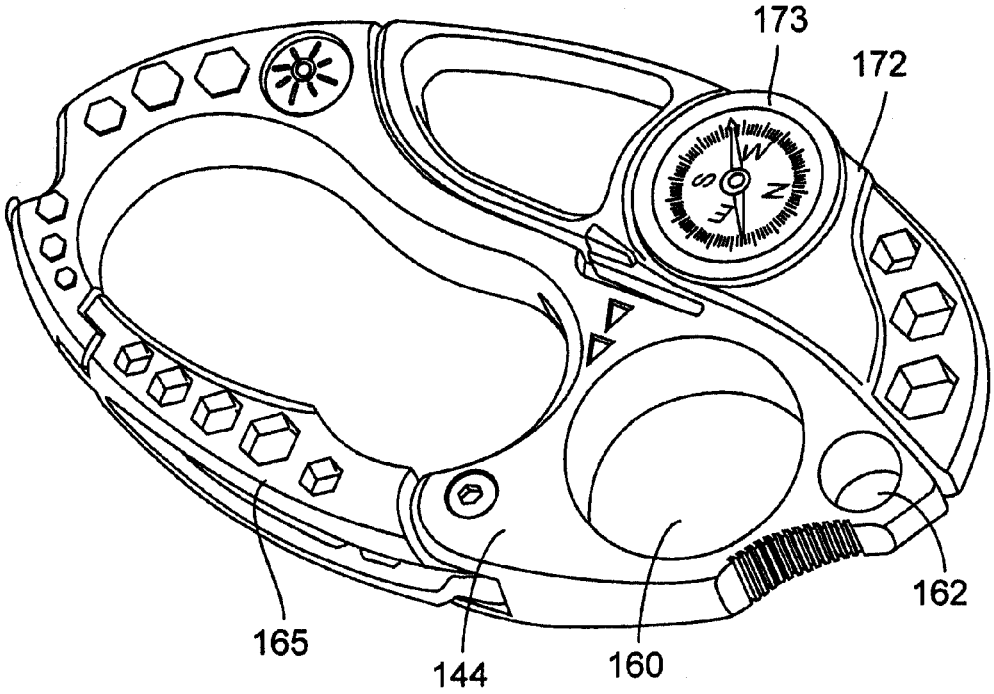
FIG. 33 is a perspective view of an apparatus having a removable compass tool.

FIG. 33 shows another embodiment. Frame 144 is shown with a compass tool 172 attached thereto. Frame 144 has a gate mechanism 156. Compass tool 172 can be attached to frame 144 in the same manner as discussed above with respect to knife tool 146. Compass 173 is desirably secured to compass tool 172 by snap fitting compass 174 into an appropriately sized opening. Alternatively, compass 173 could be secured to compass tool 172 by any other suitable means. For example, the compass tool 172 could have a threaded opening and the compass could be made with threads that mate with the threaded opening. Alternatively, compass 173 could be held in the aperture by a magnetic force. Accordingly, various tools could be formed by exchanging compass 173 with another similarly sized tool. Compass tool 172 is not shown with a sliding latch mechanism, however, such a feature could be included on compass tool 172 and the other tools discussed below, if desired.

Figure 34:
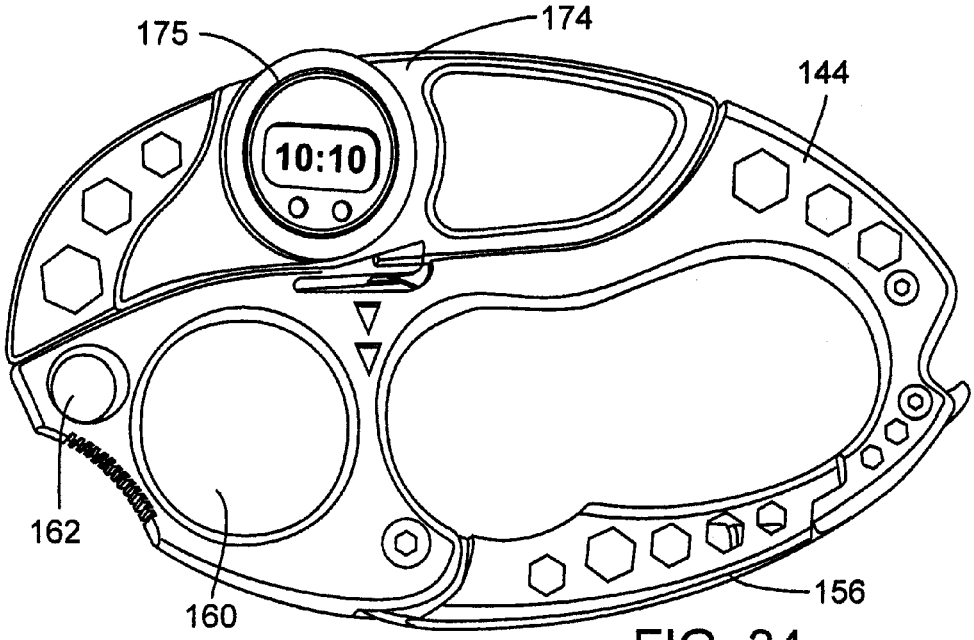
FIG. 34 is a perspective view of an embodiment showing an apparatus with a removable clock tool.

FIG. 34 shows another embodiment. Frame 144 is shown with a clock tool 174 attached thereto. Frame 144 has a gate mechanism 156. Clock tool 174 can be attached to frame 144 in the same manner as discussed above with respect to knife tool 146. Clock tool 174 desirably has a clock 175 that is removable in the manner discussed above with respect to compass 173.

Figure 35:
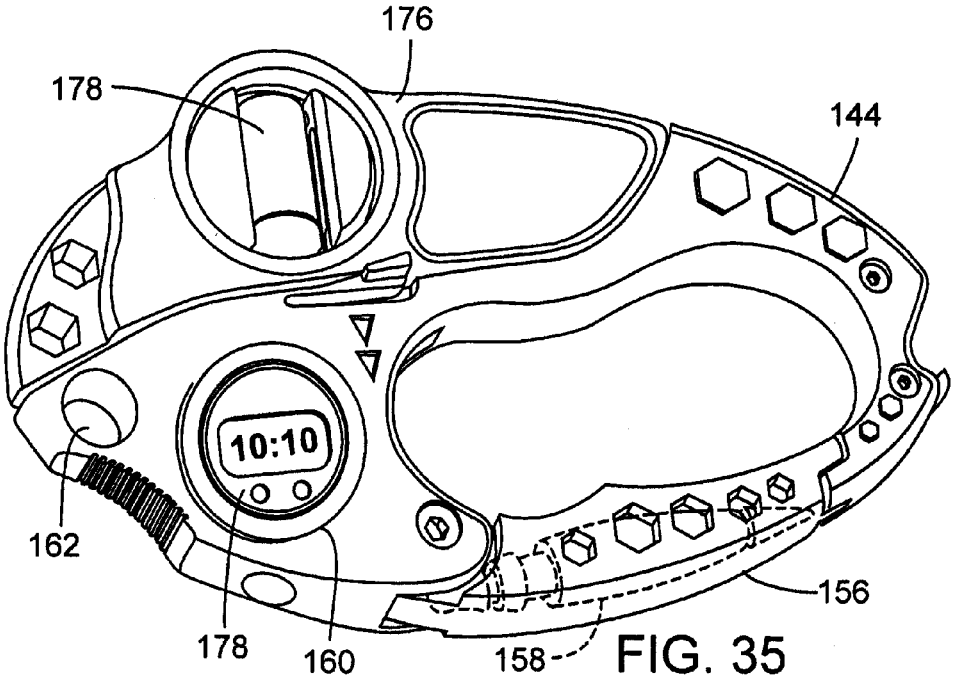
FIG. 35 is a perspective view of an embodiment showing an apparatus with a removable light source.

FIG. 35 shows another embodiment. Frame 144 is shown with a light tool 176 attached thereto. Frame 144 has a gate mechanism 156. Light tool 176 can be attached to frame 144 in the same manner as discussed above with respect to knife tool 146. Gate mechanism 156 desirably has a pen tool 158 contained within it. Light tool 176 desirably has an LED element 178 (or an incandescent bulb) that is electrically connected to a battery source (not shown). Just as with compass 173 and clock 175, LED element 178 is desirably removable from light tool 176.

In addition, large aperture 160 can be sized to receive a compass, clock, LED element, or any of various other tools. FIG. 35 shows large aperture 160 with a clock 178 held therein. Clock 178 can be held in large aperture 160 by any of the means discussed above. Small aperture 162 can similarly be used to hold tools, such as an appropriately sized clock or key ring loop.

Figure 36:
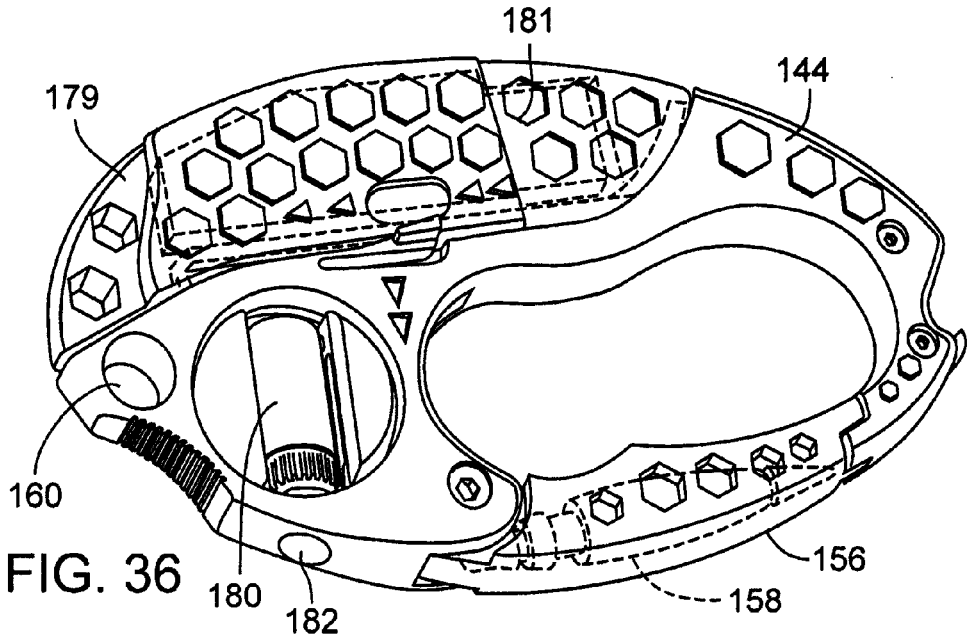
FIG. 36 is a perspective view of an embodiment showing an apparatus with a removable USB flash drive tool.

FIG. 36 shows yet another embodiment. Flash drive tool 179 is shown connected to frame 144 in the same manner as discussed above with regard to other tools and frame 144. Flash drive tool 179 has a standard USB flash drive unit 181 contained therein. Flash drive unit 181 is removable from flash drive tool 179 so that it can be connected to a computer or other type of device to access information stored on flash drive unit 181. The forward end of the tool 179 can be formed with an opening to allow the flash drive unit to be removed for use when the tool is removed from the frame. If desired, the flash drive unit 181 can have a spring to launch (provide access) to the USB connector of the flash drive.

Frame 144 has an LED element 180 contained in large aperture 160. In addition, a small opening 182 is formed in the frame 144 so that light from LED element 180 can be directed through small opening 182.

Figure 37:
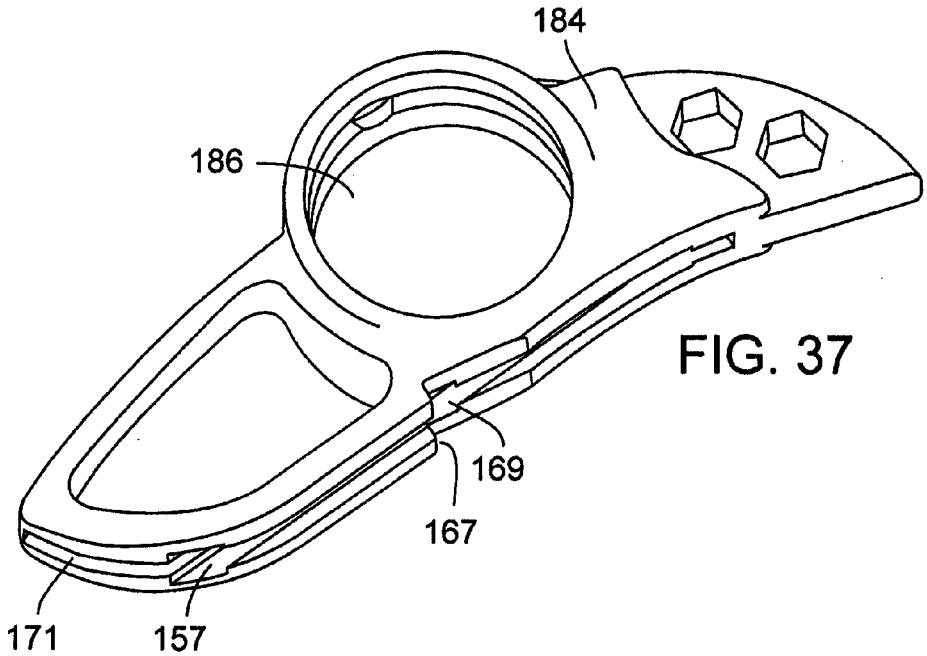
FIG. 37 is a perspective view of an embodiment showing a removable tool with an opening for receiving an additional tool.

FIG. 37 shows a tool holder 184 that can be attached to frame 144. Tool holder 184 has an aperture 186 for receiving any of various tools as discussed above with respect to aperture 180. Rail receiving section 157 has a wall 167 and a gap 169 that align with automatic locking member 152 when tool holder 184 is secured to frame 144. Opening 171 aligns with extension member 170 to help to secure tool holder 184 to frame 144.

Figure 38:
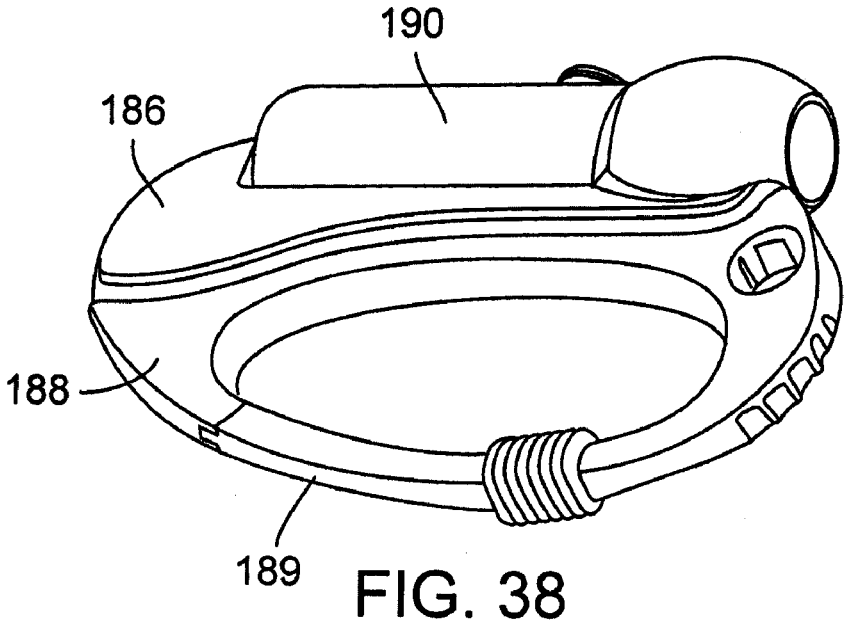
FIG. 38 is a perspective view of an embodiment showing an apparatus with a removable flashlight tool.
Figure 39:
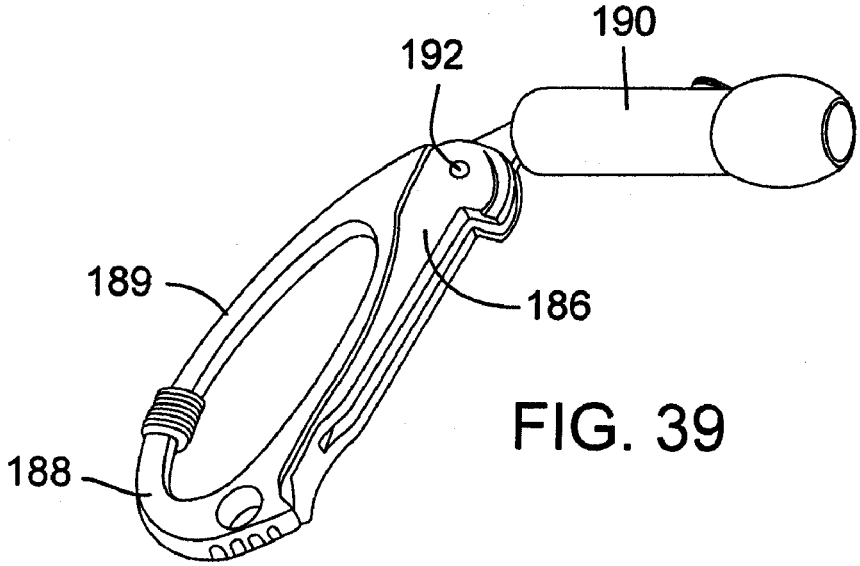
FIG. 39 is a perspective view of the apparatus of FIG. 38, showing the flashlight tool in an extended position.

FIGS. 38 and 39 show yet another embodiment. A removable flashlight tool 186 is mounted to frame 188. Frame 188 has a gate mechanism 189. Flashlight tool 186 can be secured to frame 188 in the manner discussed. Flashlight tool 186 includes a flashlight 190 that can be any conventional type flashlight, such as a battery powered flashlight with a bulb or an LED light source.

Flashlight 190 is desirably pivotably mounted to the flashlight tool 186 by a pivot mechanism 192, such as a pivot pin and pivot screw combination, so that it can be pivoted between open and closed positions. FIG. 38 shows flashlight 190 in a closed, or folded, position and FIG. 39 shows flashlight 190 in a partially open position. Flashlight 190 desirably is functional in the open position and closed positions, as well as all positions between those positions.

Figure 40:
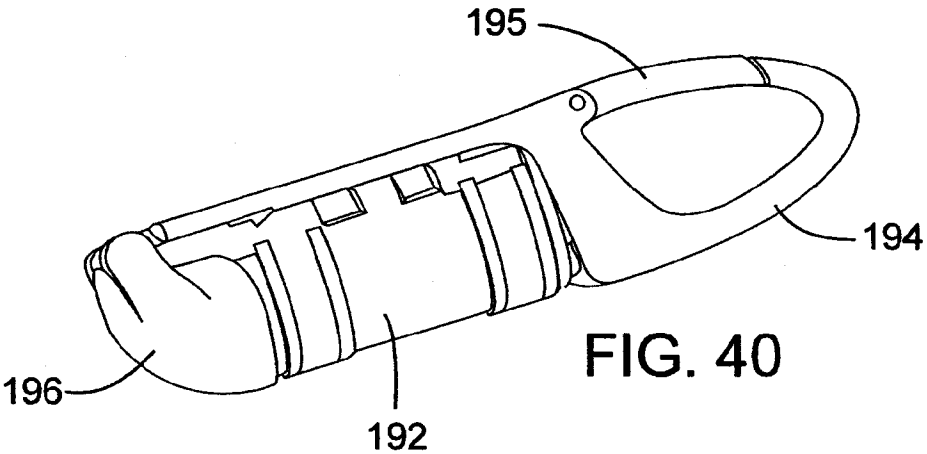
FIG. 40 is a perspective view of an embodiment showing an apparatus with a removable container.

FIG. 40 shows another embodiment. A container tool 192 is shown attached to frame 194. Frame 194 has a single gate mechanism 195. Container tool 192, like the container tool discussed above, can include a lid 196 that opens to permit access to a hollow body of container tool 192. The hollow body of the container tool 192 can be sized to receive a standard sized lighter or it can be sized to receive and store other useful items, such as pill bottles.

Although frame 194 is a shaped differently than the frames previously discussed, the method of attaching container tool 192 to frame 194 can be substantially the same. Container tool 192 can be secured by sliding a rail receiving section along rails. Latches or automatic locking mechanisms, as discussed above and not shown here, can be used to further secure the container tool 192 to frame 194.

Figure 41:
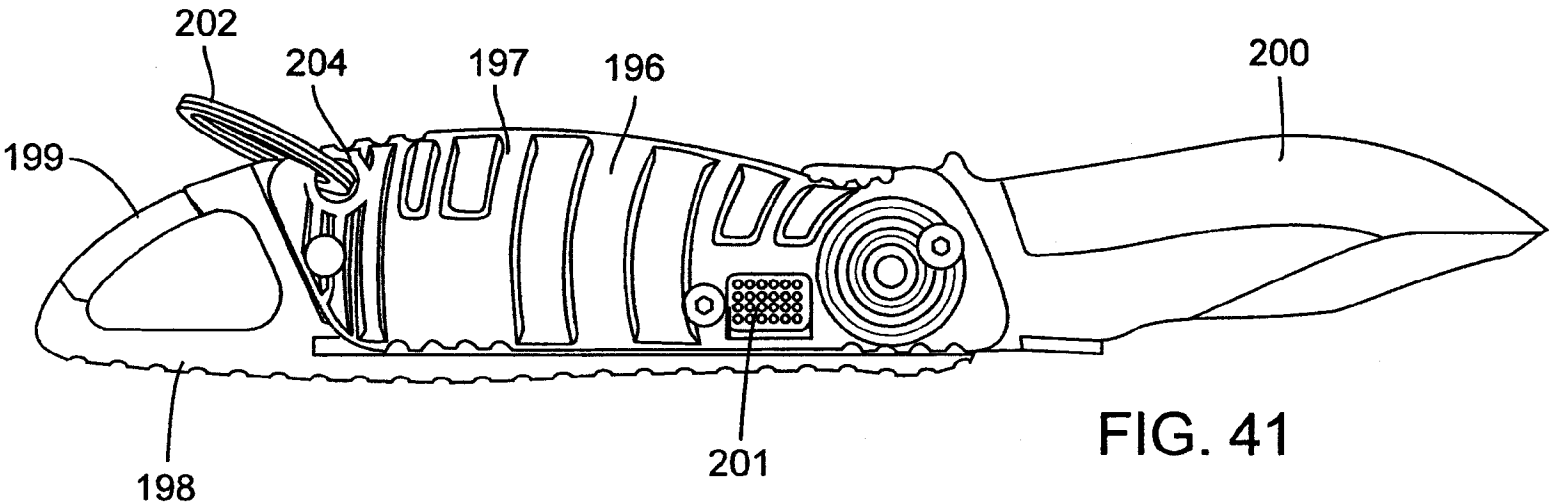
FIG. 41 is a perspective view of an embodiment showing an apparatus with a removable folding knife.
Figure 42:
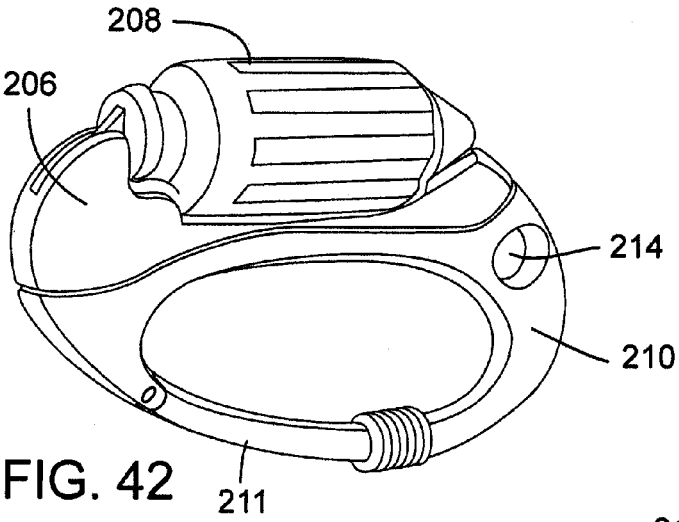
FIG. 42 is a perspective view of an embodiment showing an apparatus with a removable screwdriver tool.
Figure 43:
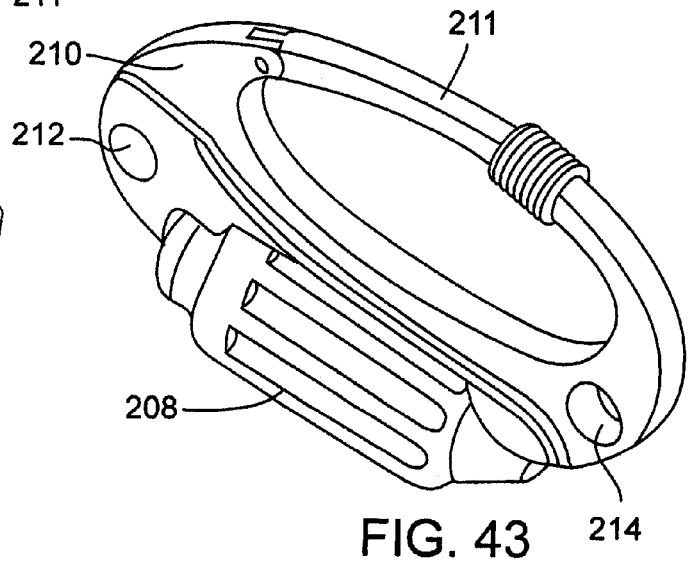
FIG. 43 is another perspective view of the apparatus of FIG. 42.
Figure 44:
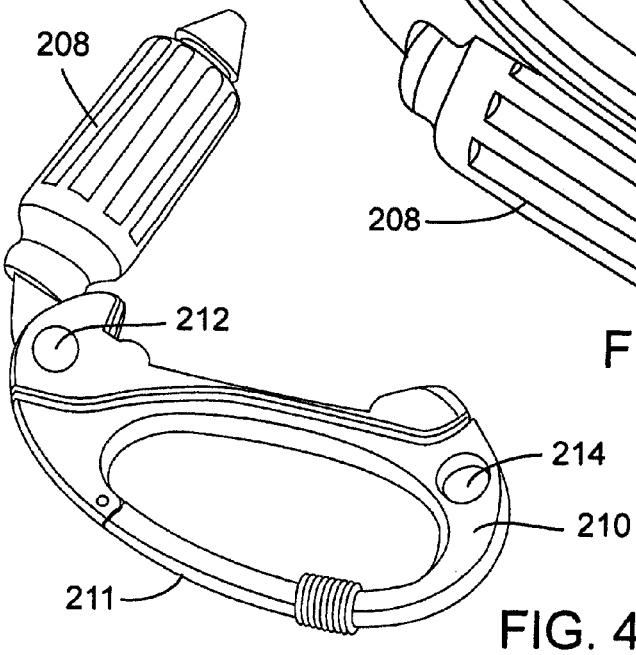
FIG. 44 is another perspective view of the apparatus of FIG. 42, showing the screwdriver tool in an extended position.

FIG. 41 shows yet another embodiment. A knife tool 196 is shown secured to a frame 198. Frame 198 has a single gate mechanism 199. Again, the knife tool 196 can be secured to the frame 198 in substantially the same manner as discussed above with regard to other embodiments disclosed herein. For example, a rocker latch mechanism 201 can be used to secure knife tool 196 to frame 198. Knife tool 196 has a blade 200 (shown extended in FIG. 41) that is pivotably mounted to handle 197 of knife tool 196. A key ring 202 is shown attached at an aperture 204 in knife tool 196.

Figure 45:
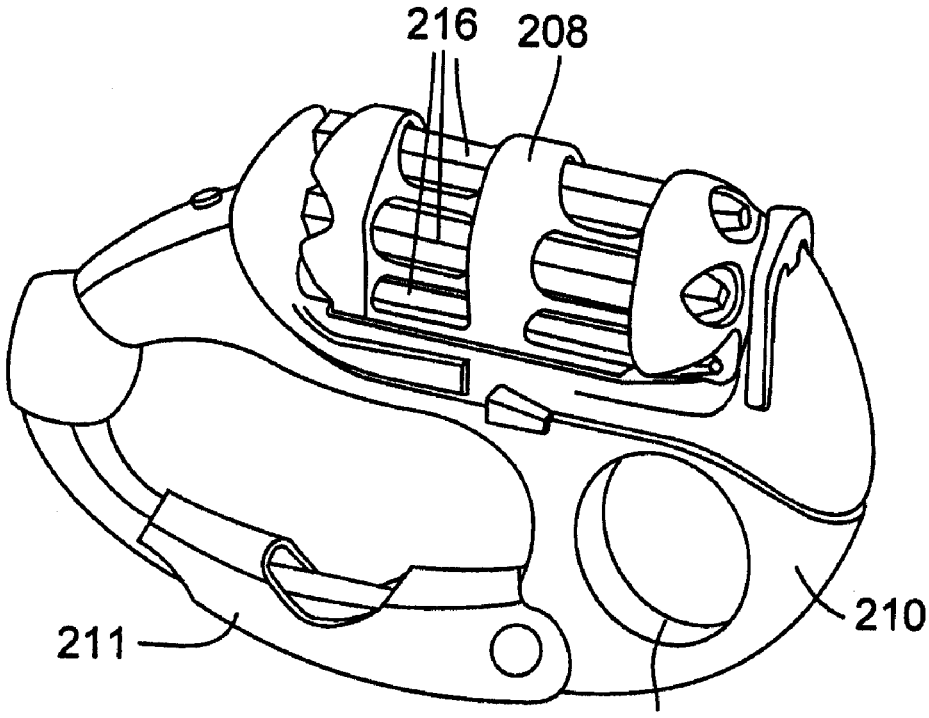
FIG. 45 is another perspective view of the apparatus of FIG. 42, with portions of the screwdriver tool removed to show certain aspects of its internal structure.

FIGS. 42-45 show yet another embodiment. A revolver bit tool 206 with a revolver bit driver 208 is shown attached to a frame 210. Frame 210 has a single gate mechanism 211. Like the flashlight tool shown in FIGS. 38-39, a revolver bit driver 208 is desirably pivotably attached to revolver bit tool 206 by a pivot mechanism 212. Frame 210 can include an aperture 214 for receiving another tool, such as a clock or key ring. FIG. 45 shows revolver bit driver 208 with a part of its side removed, exposing bits 216 held in the interior of revolver bit driver 208. Revolver bit driver 208 functions like known revolver bit screwdrivers. By rotating and laterally moving the body of revolver bit driver 208, bits 216 can be selected and moved into position for use.

Figure 46A:
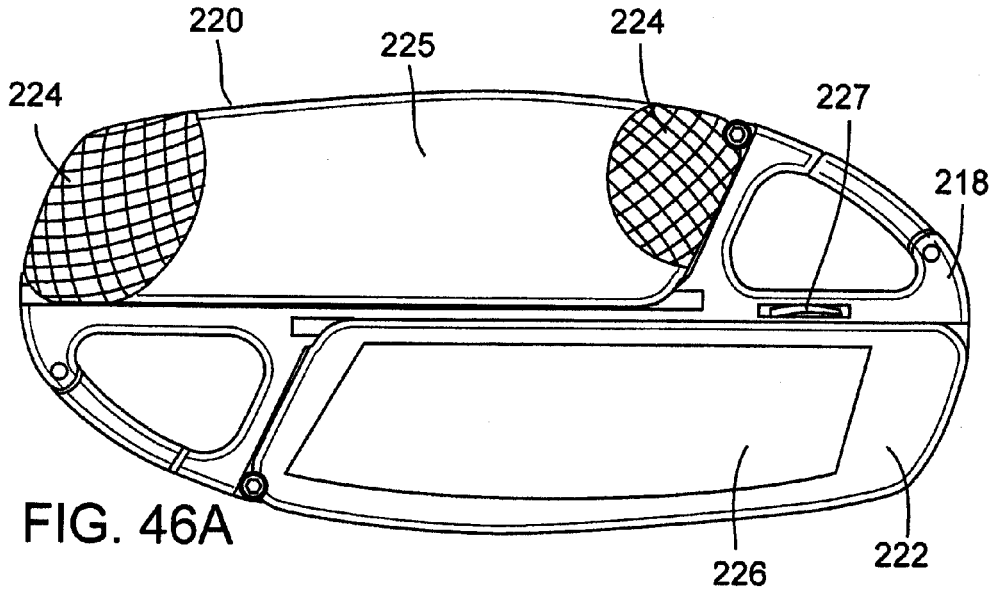
FIG. 46A is a side view of an embodiment showing an apparatus with removable electronic equipment.
Figure 46B:
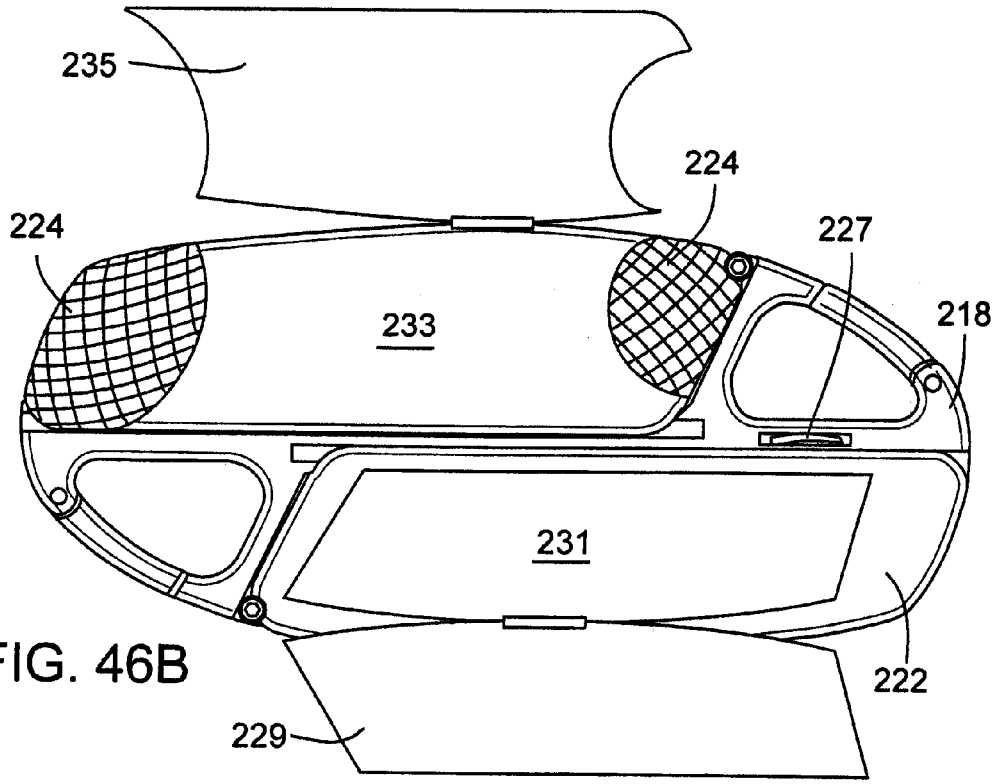
FIG. 46B is a side view of an embodiment showing an apparatus with removable electronic equipment.

FIGS. 46A and 46B show another embodiment. Frame 218 has two electronic devices 220, 222 attached thereto. Device 220 has speakers 224 at both ends and an external screen section 225 that is capable of displaying information. Device 222 can have an external display screen 226. Devices 220, 222 can comprise various other electronic devices. Devices 220, 222 can be electrically connected to each other by providing a common electrical contact point along frame 218 (not shown). That is devices 220, 222 can form an electronic circuit in both terms of sharing electrical power and offering communication and control, input and output from these devices interchangeably depending on the tool functions. In addition, if desired, both devices 220, 222 can store electrical power (e.g., through batteries) and can share power between devices.

Alternatively, devices 220, 222 can be electrically isolated and operationally distinct. Each of devices 220, 222 can also have a section that flips down to reveal an additional input or output device, such as a display screen, a keyboard, or a microphone.

As shown in FIG. 46B, external screen section 225 can flip up to reveal internal screen areas 233, 235. Alternatively external screen section 225 can flip up (or slide up) to reveal additional input areas. Similarly, external display screen 226 can flip down to reveal an additional input area 229 and an additional screen display screen 231. The size and area of the flip up members described above can vary and each flip up member can be configured to include or contain one or more of a display screen, keyboard, microphone, ear piece (removable or permanent) or speakers. In addition, instead of flipping up or down, the internal screens and/or input members can be accessed by sliding an external cover (or screen) to reveal the internal components.

Devices 220, 222 can be configured so that they can be combined together once they are removed from the tool. For example, devices 220, 222 could be two parts of an electronic game system that function together. Thus, for example, one device can be a display screen and the other device can be an input tool, and once the two devices are connected they form a single integrated game system. In this manner, the game can be functional both on the frame (if the two components are electrically connected to one another as discussed above) and off the frame (once they are combined into a single game system).

Devices 220, 222 can be secured to frame 218 in the same manners discussed above, unless modification is necessary to put the two devices in electrical contact with each other. Either or both devices 220, 222 can receive electric power from one or more batteries housed therein. Alternatively, a mechanical generator mechanism can be incorporated in the frame or in one or both devices 220, 222. For example a rotatable hand crank 227 can be rotated to generate current that can be supplied to devices 220, 222. The hand crank 227 can be stored in the frame (or in the removable tool/device) and accessed by pulling the handle outward from the frame (or tool/device). Alternatively, the gate itself can be configured to provide self-generated power. That is, by repeatedly moving the gate inward towards the frame, power can be generated.

A batter, such as a lithium-ion battery (not shown), can be stored in the frame, or in one or both of the devices 220, 222. The lithium-ion battery can store power from the hand crank 227. Alternatively, power can be supplied or supplemented to the lithium-ion battery via a solar power collector (not shown). The power from the self-powering component (e.g., the hand crank or a solar collector) can either directly power the attached components or indirectly power the attached components through the lithium-ion battery.

For each embodiment discussed herein that utilizes a power source (e.g., a battery), the frame or tool containing the battery source can also include a line-out to power other secondary devices. The line-out connection can be any standard connection for powering devices, e.g., USB powered devices, cell-phones, personal digital assistants (PDAs). In addition, the line-out can be configured to fit a supplied cable with an adapter capable of supplying power to various electronic equipment. Again, the power can be supplied to the secondary devices directly from the self-powering component or indirectly through a battery source that is storing the self-generated power.

Figure 47:
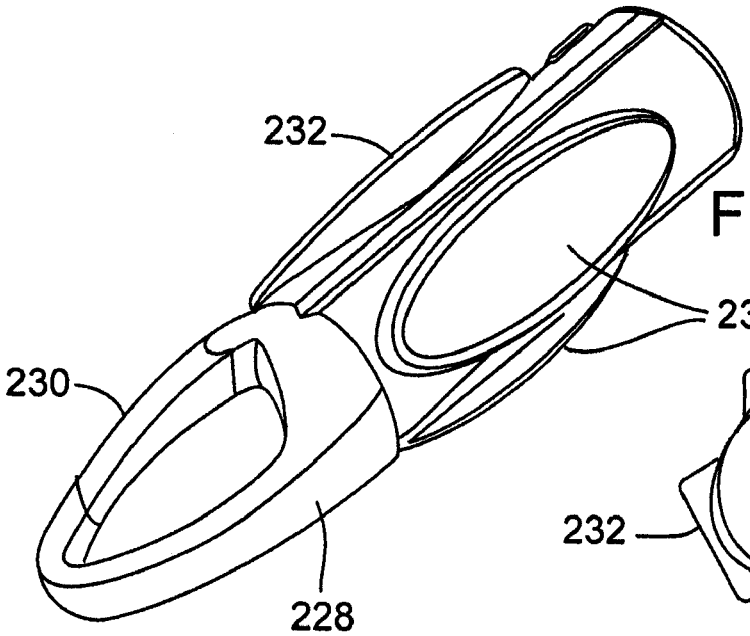
FIG. 47 is a perspective view of an embodiment showing a frame with connectors for connecting up to three tools.
Figure 49:
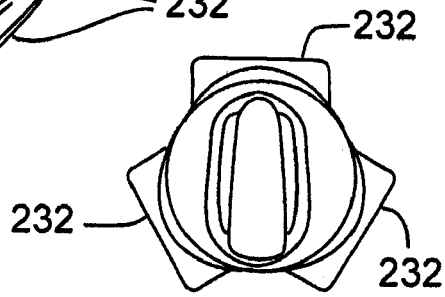
FIG. 49 is a top view of the frame of FIG. 47.
Figure 48:
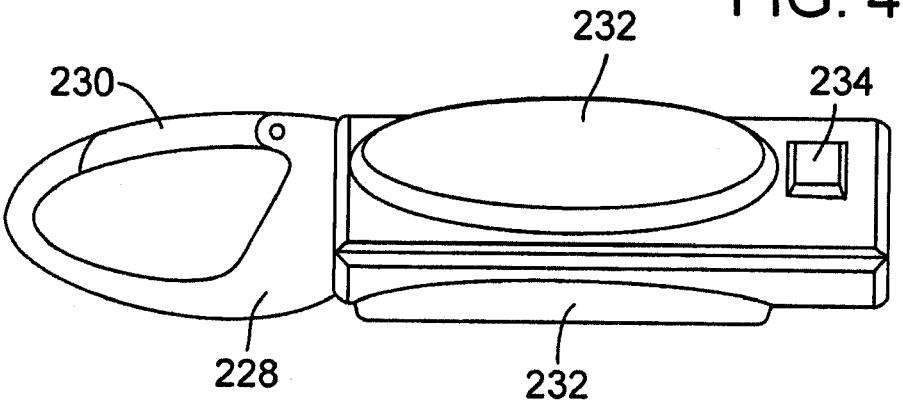
FIG. 48 is a side view of the frame of FIG. 47.

FIGS. 47-49 show another embodiment of a frame. Frame 228 includes a gate mechanism 230 and attachment portions 232. Attachment portions 232 are configured to receive a mating member of a tool (not shown) and to secure that tool, for example, by a snap fit connection. To release a tool from frame 228, a release mechanism 234 is pressed, moving attachment portions 232 downward and releasing the attached tool from frame 228. Multiple release mechanisms can be included or there could be only one release mechanism that simultaneously release all attached tools from frame 228.

Figure 50:
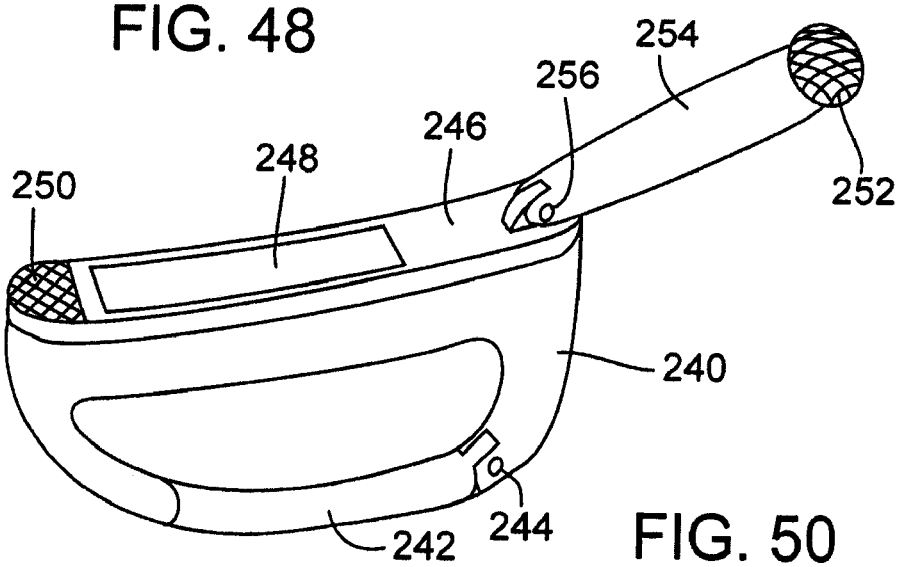
FIG. 50 is a perspective view of an embodiment showing a frame with a removable communication tool.

FIG. 50 shows another embodiment of an apparatus with a removable tool. Frame 240 includes a gate mechanisms 242 pivotably attached to frame 240 by pivot mechanism 244. A communication tool (or device) 246 is slidably attached to frame 240. Communication tool 246 may desirably include a conventional type cellular phone that is capable of receiving voice and/or data information. Communication tool 246 can include a screen 248, a microphone 250, and an ear piece 252. Screen 248 can include a touch pad for inputting information to the tool as well as a display for displaying information received by the tool. Microphone 250 is shown attached at a base of the tool 246 to receive sound. Ear piece 252 can be pivotably attached to arm 254 through pivot mechanism 256 so that it can swing open when desired. Arm 254 can be biased as well, so that when arm 254 is released from by pressing or operating a release mechanism (not shown) it will automatically open. Communication tool 246 may be attached and removed from frame 240 in the manner disclosed above with respect to other embodiments. The ear piece 252 can also be removable from arm 254 so that it can be used separately from the communication tool 246, via a wireless medium such as, for example, Bluetooth™.

If desired, a removable earpiece or hand held component/cell phone can communicate via Bluetooth™ or other wireless standards to the base frame in the configuration or to another electronic device such as an external computer capable of receiving/transmitting a signal. Power can also be gained from the base unit (frame) to power the earpiece. Thus, when the earpiece is removed from the frame, it is self-powered.

Figure 51:
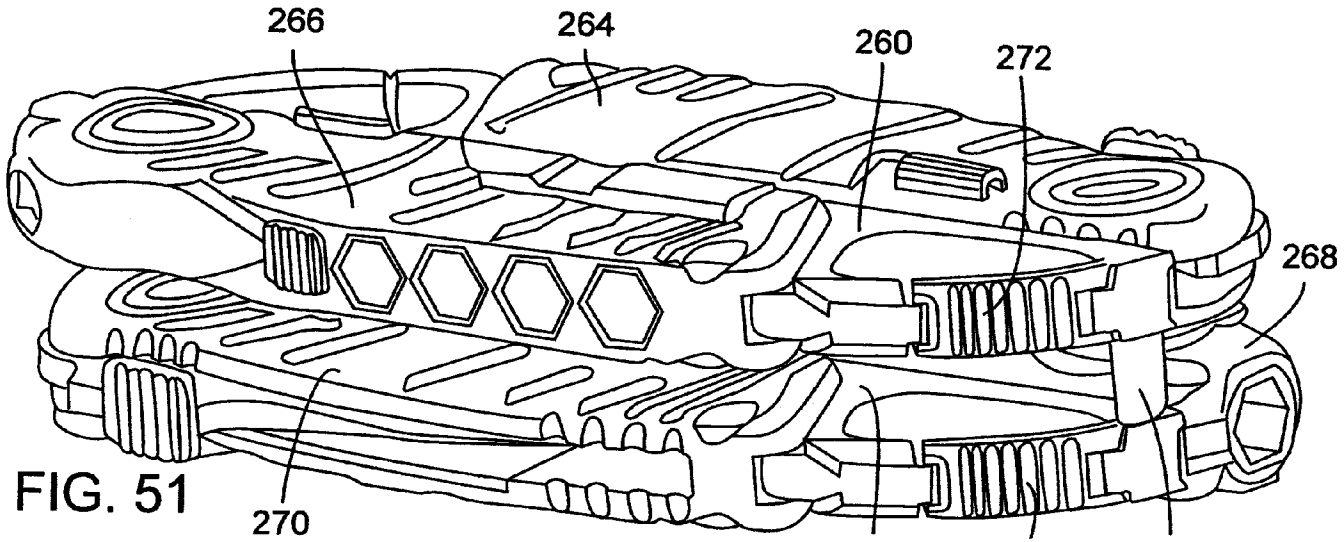
FIG. 51 is a perspective view of an embodiment showing a first and second frame system connected together.
Figure 52:
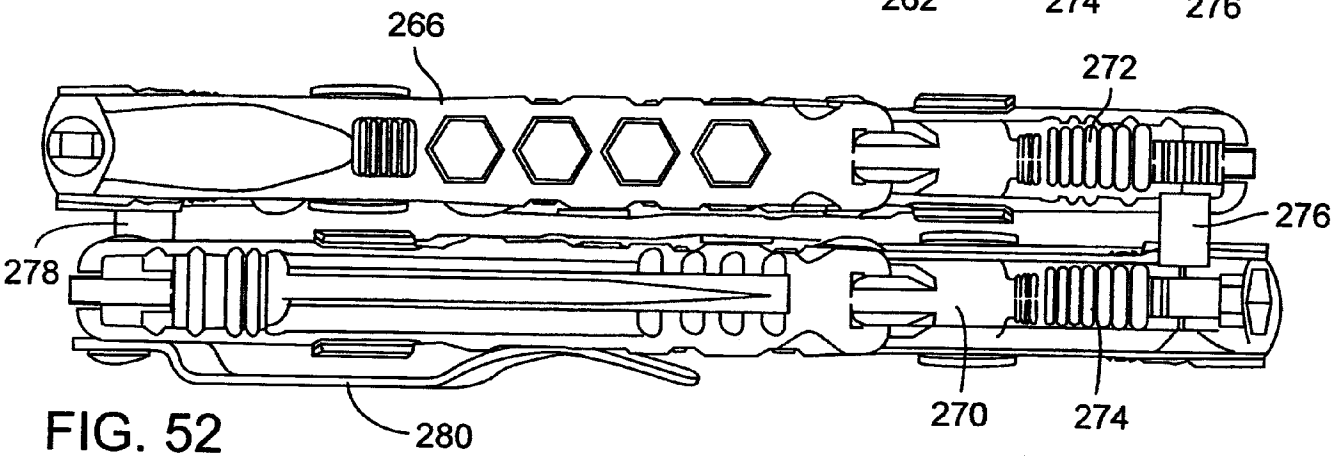
FIG. 52 is a bottom view of an embodiment showing a first and second frame system connected together.

FIGS. 51 and 52 show another embodiment of an apparatus with removable tools. As shown in FIG. 51, two separate frame systems can be combined together to form a single tool. In this manner, four or more tools can be carried at the same time. Tools 264 and 266 are connected to a first frame 260, and tools 268 and 270 are connected to a second frame 262. The first frame 260 and second frame 262 each have at least one gate mechanisms (272 and 274, respectively). Tools 264, 266, 268, and 270 can be any of the tools disclosed herein. In FIG. 51, for example, tool 266 is a bit driver tool and tool 270 is a knife tool. The first frame 260 and second frame 262 can be connected to one another by connecting members 276 and 278 (shown in FIG. 52). The connecting members 276, 278 can be pin connector rods that span between the two frames in the vicinity of the gate mechanisms. The pin connector rods can be secured to the frames using known mechanical fasteners, such as screws or snap-fit connectors. A belt clip 280 can be provided on one frame. The manner of connecting a belt clip to a frame is discussed in more detail above.

The location and system of connection for the two frame members can vary. For example, the connection system can be located elsewhere on the frame, and can include one or more points of connection. Also, the system for connecting the two frame members can include other fastening or connecting elements, such as magnets, clips, snap-fits, or other mechanical connectors.

The tools and frames described above are desirably configured so that the tool is fully functional when the tool is attached to the frame. In addition, the tool the tool is desirably fully functional when it is removed from the frame as it may be desirable in some circumstances to be able to use the tool without the encumbrance of the frame. Some tools may, however, have heightened utility when attached to the frame. For example, if the tool is configured to be electrically connected through the frame to another tool, it may be preferable to use the tool only in its attached state.

There are many variations of the above embodiments that are contemplated. For example, a frame can have one or more gate mechanisms. In addition, the location of the gate mechanism can vary along with the shape of the frame and tools. In addition, although the embodiments above show frames with one or two rail systems for receiving tools, it is contemplated that three or more rail systems could be provided.

In addition to the tools specifically disclosed above, many other types of tools could be used. For example, an apparatus according to one embodiment could include electronic equipment such as personal media devices or other electronic storage devices (e.g., MP3 players or other music players, videogame devices, video or picture players, IPOD™ holders, and AM/FM receiver with headphone plug), GPS locator devices, and communication devices (e.g., cell phones, Bluetooth™ devices, walkie-talkies, and Wi-Fi detectors). Similarly, an apparatus according to one embodiment could include personal safety devices (e.g., pepper spray and mace), multi-purpose tools systems, beverage openers (e.g., bottle openers and/or corkscrews), grooming kits (e.g., nail cutters, file, toothpick, tweezers, and scissors), sporting equipment (e.g., golf tool kit for divot repair or ball marking), pliers, hoof picks, clocks, and personal storage containers for holding money, credit cards, or passports.

In addition, as discussed above, various tools (such as clocks and compasses) can be attachable to an aperture in either the frame or the tool. The aperture need not be round but can be any desired shape, including oval, square, rectangular, or any other non-traditional shape. Tools can also be attached to other areas of the frame as well, including, for example, at the gate mechanism. In addition to the writing instrument (pen tool) disclosed above, other tools can be attached to or removably contained within the gate mechanism, such as a bit driver, toothpick holder, mini-tweezers, or other micro-tool.

Although a track or rail system is preferable for attaching and securing a tool to an apparatus, tools may be secured by other, conventional non-track locking methods. The frame has a tool receiving section that receives a mating portion of the tool. The tool receiving section can be a track or rail system as disclosed above. Alternatively, it can be some other mating system, such as an opening that receives an extending member contained on the tool or an extension member that receives an opening in the tool. To attach the tool to the frame's tool receiving area, the tool desirably has a connecting member. The connecting member may be an extending section, such as a track receiving area that extends to surround a rail or track, as discussed above. Alternatively, the connecting member may be an extending member that extends into an opening in the frame or it may be an opening that receives an extending member that extends from the frame.

The interchangeable apparatus disclosed herein provides a user with tremendous flexibility in determining which tools he or she may want to carry at any particular time. Also, by providing an interchangeable system, it is not necessary to purchase multiple independent systems, which can become costly because each individual system requires its own framework and gate mechanism.

As used in the claims, "a" means one or more. Also, the term "automatically" as used in the claims means that there is no additional manual activation required to perform the specified action. For example, as discussed above with regard to certain embodiments, a tool that slides onto a frame can be "automatically" secured to the frame such that the automatic locking action takes place without any manual activation of a switch or latch to secure the tool to the frame.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An apparatus comprising:

a frame, the frame having an opening and a gate mechanism partially bounding the opening; and at least one tool removably attached to the frame, wherein the frame has at least one of a longitudinally extending rail or a slot, and the tool has at least one of a complementary longitudinally extending rail to be received in the slot or a complementary slot adapted to receive the longitudinally extending rail, and wherein the gate mechanism comprises a gate that is coupled to the frame, the gate being movable relative to the frame to permit access to the opening.

2. The apparatus of claim 1, further comprising a locking mechanism configured to secure the tool to the frame.

3. The apparatus of claim 2, wherein the locking mechanism is a latch that is movable between a locked and an unlocked position.

4. The apparatus of claim 2, wherein the locking mechanism is an automatic locking mechanism that automatically secures the tool to the frame when one of the slots receives one of the rails, the automatic locking mechanism further comprising a release mechanism to release the automatic locking mechanism so that the tool may be removed from the frame.

5. The apparatus of claim 1, wherein the tool comprises a folding knife comprising a handle and a blade that is pivotably connected to the handle.

6. The apparatus of claim 1, wherein the tool comprises a flashlight.

7. The apparatus of claim 1, wherein the tool comprises a container with an interior section.

8. The apparatus of claim 1, wherein the container is sized to store a lighter.

9. The apparatus of claim 1, wherein the tool comprises a bit driver.

10. The apparatus of claim 1, wherein the tool comprises an electronic device.

11. The apparatus of claim 10, wherein the electronic device is a flash drive.

12. The apparatus of claim 1, wherein the at least one tool comprises a first and second tool, and the frame comprises at least two longitudinally extending rails, wherein each of the first and second tools has a slot adapted to receive one of the rails so that both tools can be removably attached to the frame at the same time.

13. The apparatus of claim 1, wherein the at least one tool comprises a first tool, a second tool, and a third tool, and the frame comprises at least three longitudinally extending rails, wherein each of the first, second, and third tools has a slot adapted to receive one of the rails so that all three tools can be removably attached to the frame at the same time.

14. The apparatus of claim 1, where the frame further comprises an aperture for receiving a secondary tool, the secondary tool being configured to be removably attached at the aperture.

15. The apparatus of claim 14, wherein the aperture is substantially cylindrical and the secondary tool is shaped to fit into the substantially cylindrical aperture.

16. An apparatus for carrying one or more tools, the apparatus comprising:

a frame, the frame comprising two openings, two gate mechanism, and two longitudinally extending rails, wherein each gate mechanism partially bounds one of the openings and each gate mechanism comprises a gate that is coupled to the frame, each gate being movable relative to the frame to permit access to the opening that it partially bounds, and wherein each rail is adapted for removably mounting a tool the frame.

17. The apparatus of claim 16, wherein the frame further comprises a locking mechanism configured to secure a tool to the frame.

18. The apparatus of claim 17, wherein the locking mechanism is a latch that is movable between a locked and an unlocked position.

19. The apparatus of claim 17, wherein the locking mechanism is an automatic locking mechanism that automatically secures a tool to the frame when the tool is received by one of the rails, the automatic locking mechanism further comprising a release mechanism to release the automatic locking mechanism to permit removal of a tool from the frame.

20. The apparatus of claim 16, where the frame further comprises an aperture for receiving a secondary tool, the secondary tool being configured to be removably attached at the aperture.

21. The apparatus of claim 20, wherein the aperture is substantially cylindrical and the secondary tool is shaped to fit into the substantially cylindrical aperture.

22. An apparatus comprising:

a frame, the frame having an opening, a gate mechanism partially bounding the opening, and at least one tool receiving section; and a folding knife comprising a handle and a blade that is pivotably connected to the handle, the handle being configured to be removably coupled to the frame on the tool receiving section of the frame, wherein the gate mechanism comprises a gate that is coupled to the frame, the gate being movable relative to the frame to permit access to the opening.

23. The apparatus of claim 22, wherein the tool receiving section comprises at least one longitudinally extending rail, the handle comprises at least one slot, and the slot is adapted to receive the rail to removably attach the tool to the frame.

24. A method of exchanging tools on a frame system, the frame system comprising a frame having an opening, a gate mechanism partially bounding the opening, and a tool receiving section, the tool receiving section being adapted to receive and removably attach a tool to the frame, the gate mechanism comprising a gate that is coupled to the frame, and the gate being movable relative to the frame to permit access to the opening, the method comprising:

removing a first tool from the tool receiving section of the frame;

installing a second tool on the tool receiving section of the frame, wherein the first tool is different from the second tool in function.

25. The method of claim 24, wherein the first and second tools each comprise a slot, and the tool receiving section comprises a rail adapted to receive the slots to removably attach the first and second tools to the frame.

26. The method of claim 25, wherein the first tool is a folding knife comprising a handle and a blade that is pivotably connected to the handle.

27. A kit comprising:

a frame system comprising a frame having an opening, a gate mechanism partially bounding the opening, and a tool receiving section; and at least two tools that are different in function from each other, each tool comprising a connecting member configured to connect with the tool receiving section, wherein the tool receiving section is adapted to receive the connecting member to removably attach each of the tools to the frame, the tools are interchangeably attachable to the frame on the tool receiving section, the gate mechanism comprises a gate that is coupled to the frame, and the gate is movable relative to the frame to permit access to the opening.

28. The kit of claim 27, wherein the frame system comprises two tool receiving sections, each tool receiving section comprises a rail, each tool comprises a slot, and the rails are adapted to receive the slots to removably attach the tools to the frame.

29. The kit of claim 27, wherein the at least two tools comprises at least a first tool, a second tool, and a third tool, and wherein at least one of the first, second, and third tools is a folding knife comprising a handle and a blade that is pivotably connected to the handle.

* * * * *